US009810437B2

(12) United States Patent
Melink et al.

(10) Patent No.: US 9,810,437 B2
(45) Date of Patent: Nov. 7, 2017

(54) OPTIMAL ENERGY SAVING FOR KITCHEN HOOD SYSTEMS

(71) Applicant: Melink Corporation, Milford, OH (US)

(72) Inventors: Stephen K. Melink, Cincinnati, OH (US); Bryan D. Miller, Cincinnati, OH (US); Craig Davis, Harrison, OH (US)

(73) Assignee: Melink Corporation, Milford, OH (US)

( * ) Notice: Subject to any disclaimer, the term of this patent is extended or adjusted under 35 U.S.C. 154(b) by 356 days.

(21) Appl. No.: 14/694,149

(22) Filed: Apr. 23, 2015

(65) Prior Publication Data

US 2016/0313011 A1 Oct. 27, 2016

(51) Int. Cl.
*F24C 15/20* (2006.01)

(52) U.S. Cl.
CPC ..... *F24C 15/2021* (2013.01)

(58) Field of Classification Search
CPC ..... F24C 15/20
USPC ..... 126/694, 299 R
See application file for complete search history.

(56) References Cited

U.S. PATENT DOCUMENTS

| | | | | |
|---|---|---|---|---|
| 3,625,135 | A | 12/1971 | Carlson | |
| 3,723,746 | A | 3/1973 | Lawson et al. | |
| 4,372,195 | A | 2/1983 | Dorius | |
| 4,903,685 | A | 2/1990 | Melink | |
| 5,697,450 | A | 12/1997 | Stehling et al. | |
| 6,170,480 | B1 | 1/2001 | Melink et al. | |
| 6,188,189 | B1 | 2/2001 | Blake | |
| 6,386,460 | B2 | 5/2002 | Riley et al. | |
| 6,467,695 | B1 | 10/2002 | Riley et al. | |
| 6,467,696 | B2 | 10/2002 | Riley et al. | |
| 6,481,635 | B2 | 11/2002 | Riley et al. | |
| 7,048,199 | B2 | 5/2006 | Melink | |
| 2005/0224069 | A1* | 10/2005 | Patil | F24C 15/2021 126/299 D |
| 2008/0274683 | A1* | 11/2008 | Burdett | F24C 15/2021 454/61 |
| 2010/0318230 | A1* | 12/2010 | Liu | F24C 15/2021 700/282 |

(Continued)

FOREIGN PATENT DOCUMENTS

GB 2209070 A 4/1989

*Primary Examiner* — Avinash Savani
(74) *Attorney, Agent, or Firm* — Wood Herron & Evans LLP

(57) ABSTRACT

Systems and methods optimize energy savings associated with a kitchen hood system. Embodiments of the present invention relate to adequately exhausting a gaseous substance while minimizing the devotion of unnecessary energy. An identification module identifies a plurality of parameters associated with the kitchen hood system. Each parameter has an impact on the overall efficiency of the kitchen hood system. A weighting module weights each parameter. A weight associated with each parameter is representative of a predicted impact each parameter has on the overall efficiency that the kitchen hood system operates relative to each other parameter. An incorporation module incorporates the weight of each parameter into a reduction factor. The reduction factor is representative of an overall impact that the plurality of parameters has on the overall efficiency that the kitchen hood system operates.

46 Claims, 8 Drawing Sheets

(56) References Cited

U.S. PATENT DOCUMENTS

2011/0056479 A1* 3/2011 Thompson ..... F24C 15/20
126/299 D

* cited by examiner

700

| Type | Factor (F) | Actual Weight (W) | Typical Weight (T) | Max Weight (M) |
|---|---|---|---|---|
| **Physical Parameters** | | | | |
| Hood Style | | 1 | 1 | 2 |
| Island | 0 | | | |
| Wall Canopy | 1 | | | |
| Proximity | 2 | | | |
| Canopy Overhang | | 2 | 2 | 4 |
| Outside of Hood | -1 | | | |
| < 6" | 0 | | | |
| 6 - 12" | 1 | | | |
| > 12" | 2 | | | |
| Hood Depth | | 1 | 1 | 2 |
| <24" | 0 | | | |
| 24-35" | 1 | | | |
| 36" or greater | 2 | | | |
| Side Curtains | | 2 | 2 | 4 |
| No | 1 | | | |
| Yes | 2 | | | |
| Relative Location | | 1 | 1 | 2 |
| Dual Open End | 0 | | | |
| Single Open End | 1 | | | |
| Center | 2 | | | |
| **MUA Design Parameters** | | | | |
| MUA Discharge Proximity to Hood | | 1 | 0 | 1 |
| < 6' | 0 | | | |
| > 6' | 1 | | | |
| MUA Discharge Velocity | | 2 | 0 | 2 |
| > 300 fpm | 0 | | | |
| < 300 fpm | 1 | | | |
| MUA Introduction Style | | 2 | 2 | 4 |
| Short Circuit | -1 | | | |
| Front Face | 0 | | | |
| Front Plenum | 0 | | | |
| Ceiling Diffusers | 1 | | | |
| Rear Plenum | 2 | | | |
| Transfer Air | 2 | | | |

FIG. 7

800

| | | | | |
|---|---|---|---|---|
| | | Max Multiplier | | 0.15 |
| Example | | | | |
| **Type** | | **Factor** | **Weight** | **Reduction Factor** |
| **Physical Parameters** | | | | 0.016 |
| Hood Style | Wall Canopy | 1 | 1 | |
| Canopy Overhang | 6 - 12" | 1 | 2 | |
| Hood Depth | 36" or greater | 2 | 1 | |
| Side Curtains | Yes | 2 | 2 | |
| Relative Location | Single Open End | 1 | 1 | |
| **MUA Design Parameters** | | | | 0.054 |
| MUA Discharge Proximity to Hood | > 6' | 1 | 1 | |
| MUA Discharge Velocity | < 300 fpm | 1 | 2 | |
| MUA Introduction Style | Transfer Air | 2 | 2 | |
| | **Reduction Multiplier** | **1.070** | | |

Calculations (for each Hood Parameters and MUA Design Parameters):

Reduction Factor = [(Max Multiplier) / # of Parameter Sets]* [(Actual) - (Typical) / (Theoretical Maximum)]

Actual = $(F_1 * W_1) + (F_2 * W_2) + (F_3 * W_3)$....

Typical = $(T_1 * W_1) + (T_2 * W_2) + (T_3 * W_3)$....

Theoretical Maximum = $(M_1 * W_1) + (M_2 * W_2) + (M_3 * W_3)$....

Reduction Multiplier = 1 + (Hood Parameters Reduction Factor) + (MUA Design Reduction Factor)

Application to Actual Fan Speed

1 - ((1 - (IH Calculated Speed)) * (Reduction Multiplier)

FIG. 8

OPTIMAL ENERGY SAVING FOR KITCHEN HOOD SYSTEMS

FIELD OF THE INVENTION

The present invention relates generally to kitchen hood systems and specifically to improving the energy efficiency of kitchen hood systems.

BACKGROUND OF THE INVENTION

Commercial and institutional kitchens are equipped to prepare food for large numbers of people and may form part of or adjoin larger facilities such as restaurants, hospitals and the like. Such kitchens are typically equipped with one or more commercial duty cooking units capable of cooking large amounts of food. On such a scale, the cooking process may generate substantial amounts of cooking heat and airborne cooking by-products such as water vapor, grease particulates, smoke and aerosols, all of which must be exhausted from the kitchen so as not to foul the environment of the facility. To this end, large exhaust hoods are usually provided over the cooking units, with duct work connecting the hood to a motor driven exhaust fan located outside the facility such as on the roof or on the outside of an external wall. As the fan is rotated by the motor, air within the kitchen environment is drawn into the hood and exhausted to the outside atmosphere. In this way, cooking heat and cooking by-products generated by the cooking units follow an air flow path defined between the cooking units and outside through the hood to be exhausted from the kitchen before they escape into the main kitchen environment and perhaps into the rest of the facility.

In many conventional installations, the motor driving the exhaust fan rotates at a fixed speed. The exhaust fan thus rotates at a fixed speed as well and, therefore, tends to draw air through the hood at a constant or fixed volume rate without regard to the amount of heat or cooking by-product actually being generated. As a result, there are often times throughout a working shift where the system may be under or over-exhausting. Under-exhausting allows heat and/or cooking by-products to build up in the kitchen or other parts of the facility, which can create discomfort and also overload the building heating and ventilation or air conditioning systems ("HVAC"). Similarly, over-exhausting wastes air that has been conditioned by the building HVAC, thus requiring further burden on the HVAC systems to make up the loss. Over-exhausting also results in energy inefficiencies with regards to the system in which the fixed speed that the exhaust fan is operating exceeds what is necessary to adequately remove heat or cooking by-product from the kitchen.

In other conventional installations, the motor driving the exhaust fan rotates based on feedback received from temperature sensors positioned in the exhaust hood. An increase in temperature of the exhaust hood is indicative of an increase heat and/or cooking by-products located in the exhaust hood. The motor driving the exhaust fan then increases its speed so that an under-exhaust condition is avoided. However, the cooking units may have additional parameters that are favorable to the exhaust of the heat and/or cooking by-products so that an increase in the speed of the exhaust fan due to an increase in temperature actually results in an over-exhaust condition. Thus, unnecessary energy is devoted to the system during over-exhausting which translates to an unnecessary increase in cost associated with removing heat or cooking by-product from the kitchen.

SUMMARY OF THE INVENTION

The present invention overcomes the foregoing problems and other known shortcomings, drawbacks, and challenges of assessing the impact a plurality of parameters associated with the kitchen hood system have on the overall efficiency that the kitchen hood system operates and then adjusting operations within the kitchen hood system, such as fan velocity, based on the positive and/or negative impact of the parameters on the overall efficiency. While the present invention will be described in connection with certain embodiments, it will be understood that the present invention is not limited to these embodiments. To the contrary, the present invention includes all alternatives, modifications, and equivalents as may be included within the spirit and scope of the present invention.

In one embodiment of the present invention, a computer implemented method optimizes energy savings associated with a kitchen hood system. A plurality of parameters associated with the kitchen hood system is identified. Each parameter has an impact on an overall efficiency that the kitchen hood system operates. Each parameter is weighted. The weight associated with each parameter is representative of a predicted impact each parameter has on the overall efficiency that the kitchen hood system operates relative to each other parameter. The weight of each parameter is incorporated into a reduction factor. The reduction factor is representative of an overall impact that the plurality of parameters has on the overall efficiency that the kitchen hood system operates. A fan velocity for each fan included in the kitchen hood system is adjusted based on the reduction factor to optimize the energy savings associated with the kitchen hood system.

In another embodiment of the present invention, a system optimizes energy savings associated with kitchen hood system. An identification module is configured to identify a plurality of parameters associated with the kitchen hood system. Each parameter has an impact on an overall efficiency that the kitchen hood system operates. A weighting module is configured to weight each parameter. A weight associated with each parameter is representative of a predicted impact each parameter has on the overall efficiency that the kitchen hood system operates relative to each other parameter. An incorporation module is configured to incorporate the weight of each parameter into a reduction factor. The reduction factor is representative of an overall impact that the plurality of parameters has on the overall efficiency that the kitchen hood system operates. An adjustment module is configured to adjust a fan velocity for each fan included in the kitchen hood system based on the reduction factor to optimize the energy savings associated with the kitchen hood system.

Further embodiments, features, and advantages, as well as the structure and operation of the various embodiments, are described in detail below with reference to the accompanying drawings.

BRIEF DESCRIPTION OF THE DRAWINGS

Embodiments are described with reference to the accompanying drawings. In the drawings, like reference numbers may indicate identical or functionally similar elements.

FIG. 7 is a table depicting example parameters as well as the actual weights, typical weights, and maximum weights of those parameters;

FIG. 8 is a table depicting an example kitchen hood system with selected parameters in which the further adjustment of the fan is determined.

DETAILED DESCRIPTION OF THE INVENTION

Figure 1:
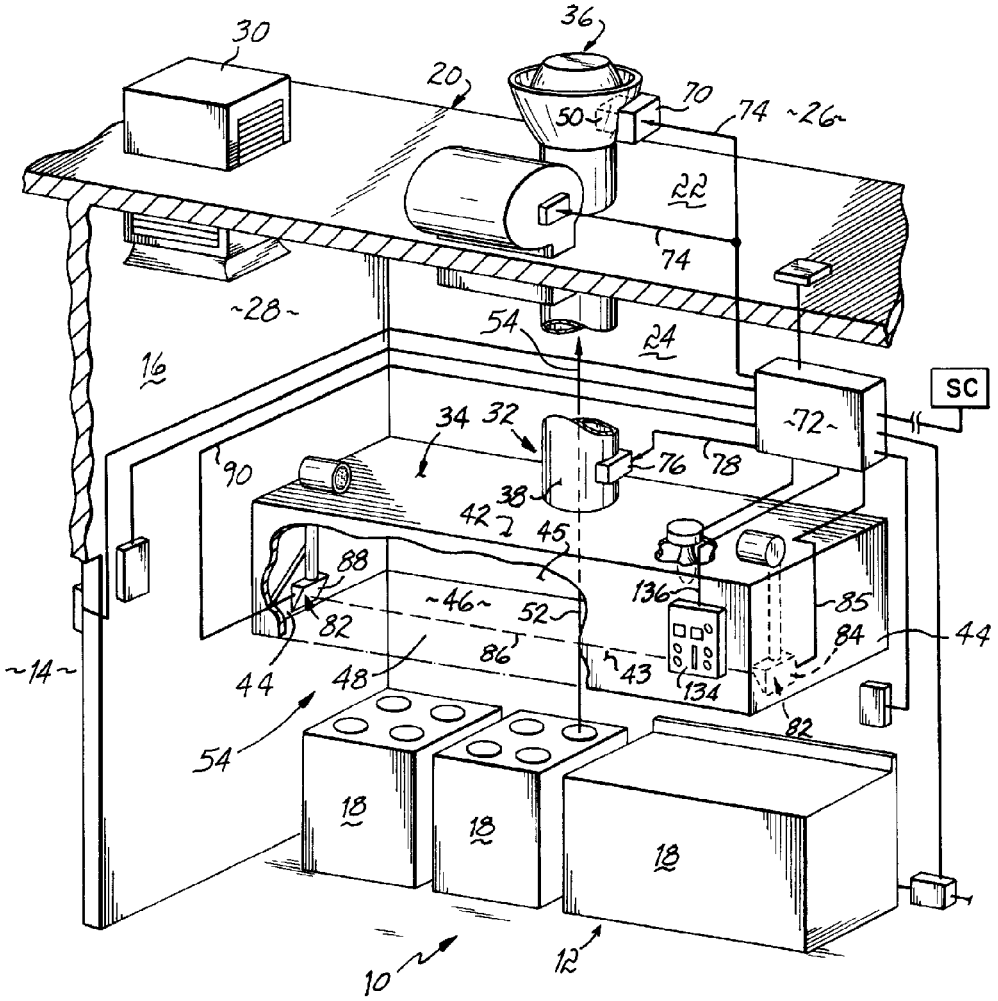
FIG. 1 is a perspective view diagrammatically illustrating a restaurant or institutional facility, primarily the kitchen area and cooking units, including a kitchen exhaust system in which embodiments of the present invention, or portions thereof, may be implemented.

The present invention generally relates to the field of commercial and institutional kitchen exhaust systems. In an exemplary embodiment of the present invention, a control module determines the impact on the overall efficiency that a plurality of parameters has on a kitchen hood system and then adjusts operations of the kitchen hood system, such as the fan velocity, based on such an impact on the overall efficiency. The kitchen hood system may implement energy optimization techniques such as adjusting the fan velocity based on the volume of gaseous substance located in the exhaust hoods of the kitchen hood system. A decrease in the volume of the gaseous substance may be indicative that there is less gaseous substance to remove from the exhaust hoods and thus the fan velocity may be decreased accordingly.

However, the control module may then further supplement such energy optimization techniques. The control module may assess the parameters associated with the kitchen hood system that have an impact on the overall efficiency of the kitchen hood system. The control module may then weight such an impact that each parameter has on the overall efficiency and then further adjust the operations of the kitchen hood system to further optimize the energy consumed by the kitchen hood system.

For example, the kitchen hood system may determine that based on the volume of the gaseous substance located in the exhaust hoods that the fan velocity is to be decreased to 80% of its maximum velocity due to a decrease in the volume of the gaseous substances. The control module may then determine that parameters associated with the kitchen hood system, such as hood style, canopy overhang, hood depth, and so on are favorable to the overall efficiency of the kitchen hood system. The control module may then determine that the fan velocity may be decreased an additional 3% to 77% while still adequately exhausting the gaseous substance from the exhaust hoods based on the favorable parameters.

In another example, the control module may determine that the parameters associated with the kitchen hood system are unfavorable to the overall efficiency of the kitchen hood system. The control module may then determine that the fan velocity should be increased an additional 3% to 83%. Despite the volume of the gaseous substance located in the exhaust hoods indicating that the fan velocity be decreased to 80%, the unfavorable impact of the parameters on the overall efficiency may actually require that the fan velocity be moderately increased to account for the unfavorable parameters rather than decreased.

In the Detailed Description herein, references to "one embodiment", "an embodiment", an "example embodiment", etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure, or characteristic is described in connection with an embodiment of the present invention, Applicants submit that it may be within the knowledge of one skilled in the art to affect such feature, structure, or characteristic in connection with other embodiments of the present invention whether or not explicitly described.

Embodiments of the present invention may be implemented in hardware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc.

For purposes of this discussion, each of the various components discussed can be considered a module, and the term "module" shall be understood to include at least one software, firmware, and hardware (such as one or more circuit, microchip, or device, or any combination thereof), and/or any combination thereof. In addition, it will be understood that each module can include one, or more than one, component within an actual device, and each component that forms a part of the described module can function either cooperatively or independently of any other component forming a part of the module. Conversely, multiple modules described herein can represent a single component within an actual device. Further components within a module can be in a single device or distributed among multiple devices in a wired or wireless manner.

The following detailed description refers to the accompanying drawings that illustrate exemplary embodiments of the present invention. Other embodiments are possible, and modifications can be made to the embodiments within the spirit and scope of this description. Those skilled in the art with access to the teachings provided herein will recognize additional modifications, applications, and embodiments within the scope thereof and additional fields in which embodiments would be of significant utility. Therefore, the detailed description is not meant to limit the present invention to the embodiments described below.

Referring to FIG. 1, a facility 10 such as a restaurant or institutional facility includes a kitchen 12 and at least one adjacent room such as a dining room 14 with an interior wall 16 separating the two rooms 12, 14. The kitchen 12 includes a plurality of commercial cooking units 18 such as one or more stoves, ovens, griddles and the like. The facility 10 is surrounded by an enclosure 20 (defined by a roof 22 and exterior walls 24 only one of which is shown in FIG. 1) which separates the outside environment 26 from the inside ambient air environment 28 of the facility 10 including the kitchen 12. The facility 10 is also equipped with a heating, ventilating and air conditioning system ("HVAC") as at 30 which maintains the inside environment 28 at a suitable condition for the use of the occupants of the facility 10.

Associated with kitchen 12 is kitchen hood system 32 including an exhaust hood 34 situated over the cooking units 18 and fluidly coupled with an exhaust assembly 36 through a duct 38. The exhaust hood 34 may be generally rectangular with a top wall 42 and depending front, sides and back walls 43, 44 and 45 to define an internal volume 46 which fluidly couples to a downwardly facing opening 48 to cooking units 18. The internal volume 46 is also fluidly coupled with exhaust assembly 36 via the duct 38 connected through top wall 42. A filter assembly (not shown) may be installed in the exhaust hood 34 to filter air pulled into duct 38 by the exhaust assembly 36. The duct 38 extends upwardly through the roof 22 of enclosure 20 and terminates in exhaust assembly 36 by which to exhaust air from the internal volume 46 to the outside environment 26. Exhaust assembly 36 may include at least one fan motor and associated with at least one fan 50 by which to expel air from the exhaust assembly 36 at a volume rate. The quantity of fans 50 included in the exhaust assembly 36 may include any quantity of fans sufficient to exhaust gaseous substances from the exhaust hood 34 that will be apparent to those skilled in the relevant art(s) without departing from the spirit and scope of the disclosure.

Thus, when the fan 50 is running, an air flow path 52 is defined between cooking units 18 and outside environment 26 through downwardly facing opening 48 of the hood 34, the internal volume 46, and duct 38. As air follows the air flow path 52, the gaseous substances generated by the cooking units 18 are drawn along to be exhausted to the outside environment 26 rather than into the rest of the facility 10. Air exhausted along the air flow path 52 is replaced by air from the ambient air environment 28 (which is defined as being outside of exhaust hood 34 and spaced away from air flow path 52) such that air is also drawn from environment 28 through hood 34 as indicated by arrow 54.

In order for the fan 50 to adequately exhaust the gaseous substance from the exhaust hood 34, the fan 50 should operate at a velocity that correlates to the volume of gaseous substance located within the exhaust hood 34. For example, as the volume of gaseous substance located within the exhaust hood 34 increases, the velocity at which the fan 50 operates should also increase in order to adequately exhaust the gaseous substance from the exhaust hood 34. The gaseous substance may represent gases generated when the cooking units 18 are in operation in that the generated gases have a temperature that may be readily detected by an exhaust temperature sensor 76. The gaseous substance may also include by-products generated when the cooking units 18 are in operation but do not have a temperature associated with such by-products that may not be readily detected by the exhaust temperature sensor 76. For example, the gaseous substance may include but is not limited to steam, water vapor, grease particulates, smoke, aerosols and/or any other type of cooking by-product generated when the cooking units 18 are in operation that is to be exhausted by the fan 50 that will be apparent to those skilled in the relevant art(s) without departing from the spirit and scope of the disclosure.

Conventionally, the fan 50 operates at a constant velocity that is sufficient to exhaust the peak volumes of the gaseous substance when the cooking units 18 are in operation. For example, after the cooking units 18 are activated, the fan 50 operates at a constant velocity that is sufficient to exhaust the greatest volumes of gaseous substance that could be conceivably generated by the cooking units 18 for the duration of when the cooking units 18 are in operation. In doing so, the operation of the fan 50 at such a high constant velocity ensures that at during any window of operation of the cooking units 18, the gaseous substance is adequately exhausted despite the volume level of the gaseous substance. However, the cooking units 18 may not generate peak volumes of gaseous substances for the entire duration that the cooking units 18 are in operation. As a result, unnecessary energy is devoted to the fan 50 when the constant velocity with which the fan 50 is operating results in unnecessary increases in cost in maintaining the kitchen hood system 32.

Another conventional approach includes the adjustment of the velocity with which the fan 50 operates based on the temperature of the kitchen hood system 32. The exhaust temperature sensor 76 monitors the temperature of the gaseous substance located within the exhaust hood 34. As the exhaust temperature sensor 76 detects a temperature of the gaseous substance that is within specified thresholds, the velocity of the fan 50 is then adjusted accordingly.

For example, conventionally the velocity of the fan 50 is increased when the temperature detected by the exhaust temperature sensor 76 exceeds a specified threshold indicating that an increased volume of the gaseous substance is located within the exhaust hood 34 and thus requiring that the fan 50 operate at higher velocities to adequately exhaust the gaseous substance. The velocity of the fan 50 is then conventionally decreased when the temperature detected by the exhaust temperature sensor 76 is below the specified threshold indicating that a decreased volume of the gaseous substance is located within the exhaust hood 34 and thus requires that the fan 50 operate at lower velocities to adequately exhaust the gaseous substance. The fan 50 is then conventionally deactivated when the exhaust temperature sensor 76 detects a temperature below a minimal threshold indicating that no gaseous substance is located within the exhaust hood 34 and thus the fan 50 is no longer required to operate.

However, the gaseous substance located within the exhaust hood 34 may not have a temperature that when detected by the exhaust temperature sensor 76 would trigger the fan 50 to increase its velocity to adequately exhaust the gaseous substance. Rather, the gaseous substance may be a gaseous substance such as steam that when present within the exhaust hood 34 would not have a temperature detected by the exhaust temperature sensor 76. The velocity of the fan 50 would then be inappropriately decreased based on the low temperature detected by the exhaust temperature sensor 76 due to the assumption that the low temperature is indicative of a decrease in the volume of the gaseous substance located within the exhaust hood 34. The fan 50 then fails to adequately exhaust the steam from the exhaust hood 34 because the fan 50 is operating at a lower velocity than is required to adequately exhaust the steam from the exhaust hood 34.

In addition to determining the volume of the gaseous substance located within the exhaust hood 34 based on temperature, the volume of the gaseous substance may also be correlated to the actual volume of the gaseous substance located within the exhaust hood 34. Sensing of the gaseous substance is accomplished with a gaseous substance sensor 82 by which to detect such gaseous substances that fail to generate a temperature sufficient to be detected by the exhaust temperature sensor 76 such as but not limited to water vapor, grease particulates, smoke and aerosols generated by the cooking units 18.

The gaseous substance sensor 82 is placed within the internal volume 46 of the exhaust hood 34, with a first optic sensor, such as an emitter 84, placed on one side wall 44 of the exhaust hood 34. The emitter 84 is powered over cable 85 and aligned to send a signal 86, such as a light beam, traversing a portion of the internal volume 46 along a light beam path to a second optic sensor, such as a detector 88, placed on an opposite side wall 44 of the exhaust hood 34.

The signal 86 may be any type of signal, such as a light beam, that when transmitted by the first optic sensor, such as the emitter 84, to the second optic sensor, such as the detector 88, that the magnitude of the signal 86 may be monitored by the control module 72 such that any fluctuations in the magnitude of the signal 86 may be adequately captured and analyzed that will be apparent to those skilled in the relevant art(s) without departing from the spirit and scope of the disclosure. Further, the first optic sensor and the second optic sensor may include any combination and/or any quantity of emitters and/or detectors so that the signal 86 is adequately transmitted and received so that the magnitude of the signal may be monitored by the control module 72 that will be apparent to those skilled in the relevant art(s) without departing from the spirit and scope of the disclosure.

Having the signal 86 traverse the longitudinal length of the exhaust hood 34 provides for an accurate measurement of the gaseous substance since the signal 86 passes above each of the plurality of cooking units 18 and just outside of the normal air flow path 52. The gaseous substance sensor 82 will output the gaseous substance signal 90 to the control module 72 corresponding to the level of the gaseous substance interrupting the signal 86. The control module 72 utilizes the gaseous substance signal 90 along with, or alternatively to, the heat level signal 78, to cause the control module 72 to initiate different graduated actions based on the gaseous substance signal 90. The different graduated actions may be actions initiated by the control module 72 within the kitchen hood system 32 that are in response to the heat level signal 78 and the gaseous substance signal 90.

For example, the magnitude of the signal 86 may fluctuate based on the volume of the gaseous substance that is located within the exhaust hood 34. As the magnitude of the signal 86 decreases, this may be indicative that the volume of the gaseous substance has also increased. The increase in the volume of the gaseous substance may correspond to an increase in the density of the gaseous substance located between the emitter 84 and the detector 88. A reduction in the magnitude of the signal 86 may then result due to an increase in the density of the gaseous substance located between the emitter 84 and the detector 88. As a result, the control module 72 may monitor the magnitude of the signal 86 to determine that a drop in magnitude is indicative of an increase in the volume of the gaseous substance located within the exhaust hood 34.

As the magnitude of the signal 86 increases, this may be indicative that the volume of the gas substance has also deceased. The decrease in the volume of the gaseous substance may correspond to a decrease in the density of the gaseous substance located between the emitter 84 and the detector 88. An increase in the magnitude of the signal 86 may then result due to a decrease in the density of the gaseous substance located between the emitter 84 and the detector 88. As a result, the control module 72 may monitor the magnitude of the signal 86 to determine that an increase in magnitude is indicative of a decrease in the volume of the gaseous substance located within the exhaust hood 34.

In such an example, the control module 72 may initiate a graduated action in adjusting the velocity in which the fan 50 operates based on the magnitude of the signal 86. The control module 72 may increase the velocity in which the fan 50 operates as the magnitude of the signal 86 decreases because such a decrease in magnitude is indicative of an increase in the volume of the gaseous substance located in the exhaust hood 34, thus requiring that the fan 50 operate at higher velocities to adequately exhaust the gaseous substance.

The control module 72 may decrease the velocity in which the fan 50 operates as the magnitude of the signal 86 increases because such an increase in magnitude is indicative of a decrease in the volume of the gaseous substance located in the exhaust hood 34, thus requiring the fan 50 to operate at lower velocities to adequately exhaust the gaseous substance. The velocity of the fan 50 may then be customized to the volume of the gaseous substance located in the exhaust hood 34 so that the gaseous substance is adequately exhausted while preventing the devotion of unnecessary energy to operating the fan 50 at higher velocities than are necessary thus decreasing the amount of energy devoted to the exhausting as well as decreasing the overall amount of energy consumed by the kitchen hood system 32.

The primary energy optimization generated for the kitchen hood system 32 may be accomplished based on the feedback provided by the fluctuation in magnitude of the signal 86 as well as the feedback provided by the exhaust temperature sensor 76. Such feedback as mentioned above is a significant indicator as to the volume of gaseous substance located in the exhaust hood 34. Thus, graduated actions, such as the decrease in the velocity of fan 50, executed by the control module 72 may significantly decrease the amount of overall energy consumed by the kitchen hood system 32.

However, additional parameters associated with the kitchen hood system 32 may be assessed to provide additional energy optimization to that already accomplished based on the volume of the gaseous substance located in the exhaust hood 34. The additional parameters may be fixed conditions specific to the kitchen hood system 32 that despite the graduated actions executed by the control module 72 have an impact on the overall efficiency attained by the kitchen hood system 32.

For example, the additional parameters may be associated with the physical aspects of the exhaust hood 34 that are fixed and cannot be easily adjusted as compared to simply adjusting the velocity of the fan 50. The physical aspects of the exhaust hood 34 are inherent to the design and the environment of the exhaust hood 34 and are typically not modified due to the difficulty in such modification to improve the overall efficiency of the kitchen hood system 32.

In another example, the additional parameters may be associated with the make-up air design aspects of the kitchen hood system 32. Make-up air is the amount of air that is pumped back into the exhaust hood 34 to replace the air previously exhausted by the exhaust hood 34 that was required to adequately exhaust the gaseous substance from the exhaust hood 34. The make-up air design aspects have an impact on the amount of air pumped back into the exhaust hood 34 which then in turn has an impact on the overall efficiency of the kitchen hood system 32.

The additional parameters associated with the kitchen hood system 32, such as the physical parameters and/or the make-up air design parameters, that may be assessed to have a further impact on the overall efficiency of the kitchen hood system 32 may be any type of parameter associated with the kitchen hood system 32 that is not easily modified and has an impact on the overall efficiency of the kitchen hood system 32 that will be apparent to those skilled in the relevant art(s) without departing from the spirit and scope of the disclosure.

As noted above, the parameters may be favorable to improving the overall efficiency so that additional graduated actions, such as decreasing the velocity of fan 50 even further, may also be executed by the control module 72 to further decrease the amount of overall energy consumed by the kitchen hood system 32. The parameters may also be unfavorable to improve the overall efficiency so that the initial graduated actions executed by the control module 72, such as initially decreasing the velocity of the fan 50, may not be sufficient to decrease the overall energy consumed by the kitchen hood system 32 to an optimal level. Rather the unfavorable parameters may result in an increase in the overall energy consumed by the kitchen hood system 32. Thus, contradictory graduated actions, such as increasing the velocity of the fan 50 by the control module 72 despite the volume of the gaseous substance located in the exhaust hood 34 may be required to compensate for the loss of exhaust due to the unfavorable parameters.

As a result, the control module 72 may assess the parameters associated with the kitchen hood system 32 that are not only favorable to the overall efficiency of the kitchen hood system 32 but also those parameters that are unfavorable. In assessing the parameters, control module 72 may weight the impact each parameter has on the overall efficiency of the kitchen hood system.

For example, a hood depth parameter is associated with the depth of the capture tank of the exhaust hood 34. The capture tank of the exhaust hood 34 includes the opening of the exhaust hood 34 that is positioned over the cooking units 18 and confines the gaseous substance so that the gaseous substance may be easily exhausted. The hood depth parameter is a physical aspect of the exhaust hood 34 that is not typically modified to improve the overall efficiency of the kitchen hood system 32 but is rather fixed. The greater the hood depth, the greater amount of gaseous substance that may be initially captured by the exhaust hood 34 from the cooking units 18 and contained until the fan 50 evacuates the gaseous substance from the exhaust hood 34. As a result, the greater the hood depth may result in a greater impact of the overall efficiency of the kitchen hood system 32.

In such an example, the control module 72 may weight a hood depth of 36 inches or greater more than a hood depth of less than 24 inches due to the improved impact that the greater hood depth has on the overall efficiency as opposed to a lesser hood depth. The control module 72 may initiate additional graduated actions, such as further decreasing the velocity of the fan 50 from 80% to 77% when a hood depth of 36 inches or greater is included in the exhaust hood. Such a further decrease in velocity may be possible because the greater hood depth contains a greater amount of gaseous substance for a longer duration as opposed to a smaller hood depth. The fan 50 may still adequately exhaust the gaseous substance from the exhaust hood 34 at a slightly less velocity due to the greater amount of exhaust being contained with the greater hood depth and thus preventing the gaseous substance from escaping. An additional decrease in the velocity of the fan 50 although slight may result in additional energy savings of the kitchen hood system 32.

In another example, the control module 72 may weight the hood depth of less than 24 inches as having minimal impact on the overall efficiency of the kitchen hood system 32. Based on such a minimal impact, the control module 72 may refrain from initiating additional graduated actions such as increasing and/or decreasing the velocity of the fan 50 due to the minimal impact of the hood depth of less than 24 inches. The fan 50 may continue to operate at 80% to adequately exhaust the gaseous substance regardless of the hood depth of less than 24 inches.

Figure 2:
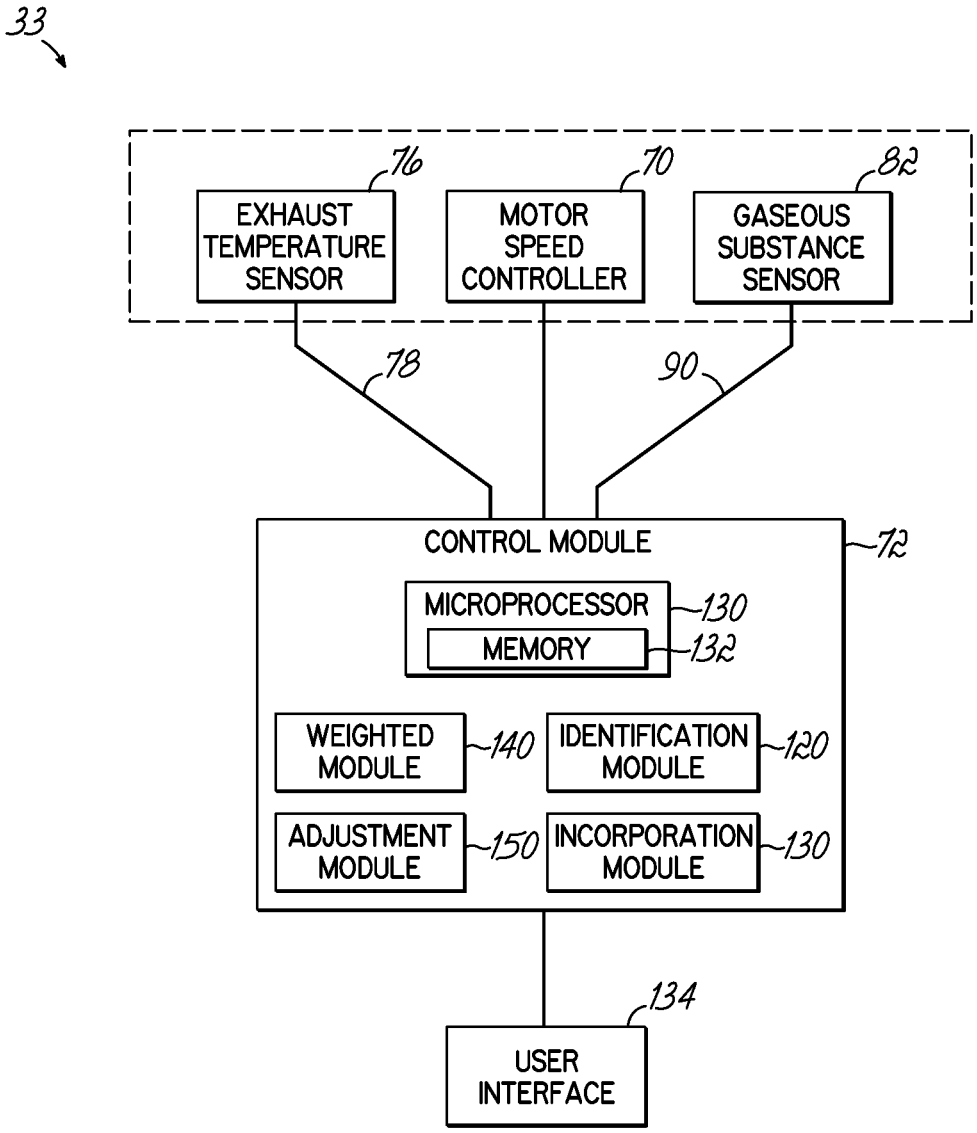
FIG. 2 is a block diagram of an exhaust system for use in the kitchen exhaust system of FIG. 1 in which embodiments of the present invention, or portions thereof, can be implemented.

FIG. 2 illustrates an exhaust control system 33 in which embodiments of the present invention, or portions thereof, may be implemented. The exhaust control system 33 includes the control module 72, user interface 134, the gaseous substance sensor 82, the exhaust temperature sensor 76, and the motor speed controller 70. The control module 72 includes a microprocessor 130, a memory 132, a weighting module 140, an adjustment module 150, an identification module 120, and an incorporation module 130.

In one embodiment of the present invention, one or more control modules 72 may connect to one or more modules that when commands are received by the control module 72, each module initiates a graduated action within the kitchen hood system 32 to adequately exhaust the gaseous substance located within the exhaust hood 34 while minimizing the amount of unnecessary energy devoted to the exhaust. Each module may also initiate an additional graduated action that supplements the initial graduated action that further minimizes the amount of unnecessary energy devoted to the exhaust.

The one or more modules may include temperature sensors, gaseous substance sensors, motor speed controllers, auxiliary accessory controllers and/or any other module that may initiate a graduated action and/or an additional graduated action within the exhaust system 32 to adequately exhaust the gaseous substance while minimizing the amount of energy devoted to the exhaust that will be apparent to those skilled in the relevant art(s) without departing from the spirit and scope of the disclosure.

The control module 72 includes a microprocessor 130 and a memory 132 and may be referred to as a computing device or simply "computer." For example, the control module 72 may be a workstation, mobile device, computer, cluster of computers, set-top box, or other computing device. In one embodiment of the present invention, multiple modules may be implemented on the same computing device. Such a computing device may include software, firmware, hardware, or a combination thereof. Software may include one or more applications on an operating system. Hardware can include, but is not be limited to, microprocessor 130, the memory 132, and/or the user interface 134.

The control module 72 may communicate with each of the gaseous substance sensor 82, the exhaust temperature sensor 76, and the motor speed controller 70, via serial communication, wireless communication and/or a wired connection. Serial communication may occur using serial semantics, such as RS45 multi-drop serial communication. However, any type of serial communication may be implemented that will be apparent from those skilled in the relevant art(s) without departing from the spirit and scope of the present disclosure.

Wireless communication may occur via one or more networks such as the internet. In some embodiments of the present invention, the network may include one or more wide area networks (WAN) or local area networks (LAN). The network may utilize one or more network technologies such as Ethernet, Fast Ethernet, Gigabit Ethernet, virtual private network (VPN), remote VPN access, a variant of IEEE 802.11 standard such as Wi-Fi, and the like. Communication over the network takes place using one or more network communication protocols including reliable streaming protocols such as transmission control protocol (TCP). These examples are illustrative and not intended to limit the present invention. Wired connection communication may occur with but is not limited to a fiber optic connection, a coaxial cable connection, a copper cable connection, and/or any other direct wired connection that will be apparent from those skilled in the relevant art(s) without departing from the spirit and scope of the present disclosure.

The user interface 134 may provide an operator the ability to interact with the control module 72. The user interface 134 may be any type of display device including but not limited to a touch screen display, a liquid crystal display (LCD) screen, and/or any other type of display that will be apparent from those skilled in the relevant art(s) without departing from the spirit and scope of the present disclosure.

As will be discussed in more detail below, the control module 72 may engage the identification module 120, the weighting module 140, the incorporation module 130 and the adjustment module 150 to properly incorporate the overall impact of each of the parameters on the overall efficiency of the kitchen hood system 32. Determining additional graduated actions that may be executed by the control module 72 may further decrease the amount of unnecessary energy devoted to the kitchen hood system 32 and improve the overall efficiency of the kitchen hood system 32.

Figure 3:
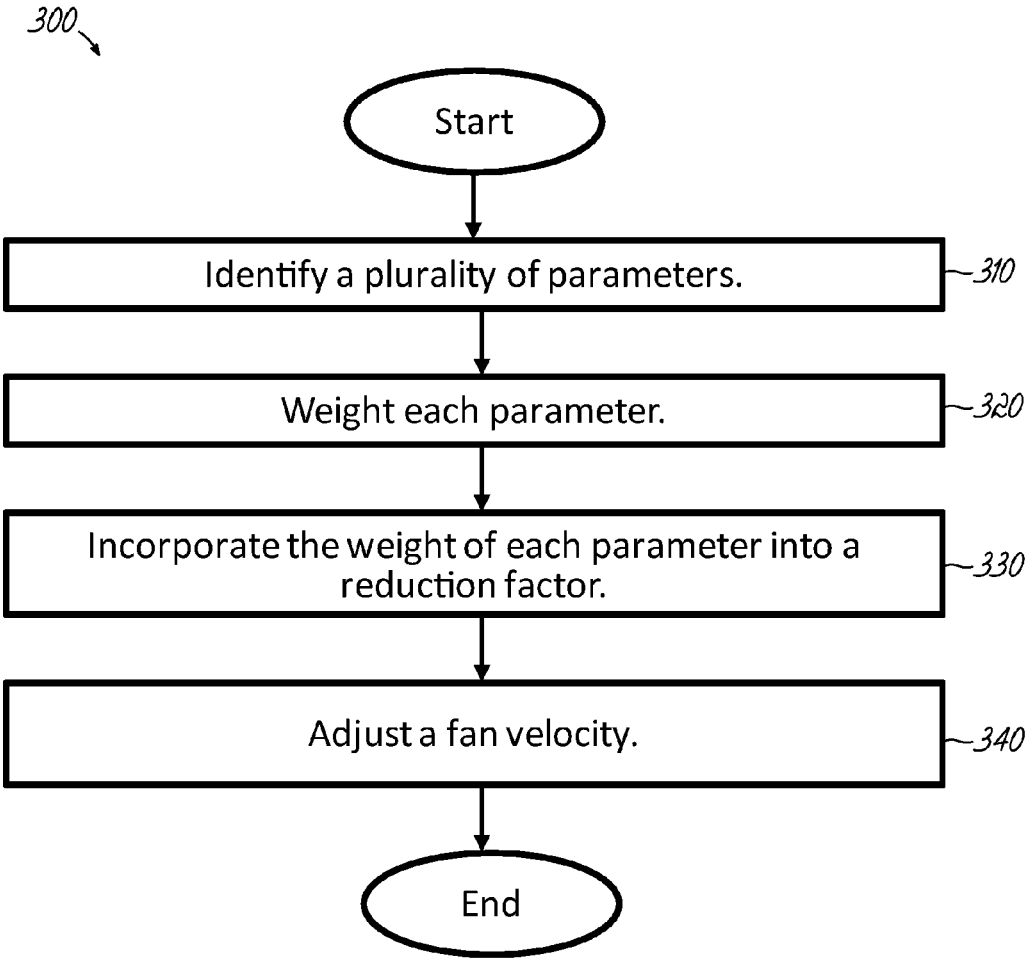
FIG. 3 is a flowchart showing an example method for further optimizing energy savings associated with the kitchen hood system.

Referring now to FIG. 3, a flowchart is presented showing an exemplary process 300 for further optimizing energy savings associated with the kitchen hood system 32. As noted above, the control module 72 may initiate additional graduated actions that supplement the graduated actions already initiated based on the volume of the gaseous substance to further improve the overall efficiency of the kitchen hood system 32.

At step 310, the identification module 120 may identify the parameters associated with the kitchen hood system 32 with each parameter having an impact on the overall efficiency of the kitchen hood system 32. As noted above, the parameters may be fixed characteristics of the kitchen hood system 32 that are not easily modified. When taken into account, the parameters may have a favorable and/or an unfavorable impact on the overall efficiency of the kitchen hood system 32. As noted above parameters may be associated with the physical characteristics of the kitchen hood system 32 and may be referred to as physical parameters. The parameters may also be associated with the make-up air characteristics of the kitchen hood system 32 and may be referred to as make-up air design parameters.

Examples of physical parameters may include but are not limited to hood style, canopy overhang, hood depth, side curtains, relative location and/or any other parameter that is a physical characteristic of the kitchen hood system 32 that is not easily modified but yet has an impact on the overall efficiency of the kitchen hood system 32 that will be apparent to those skilled in the relevant art(s) without departing from the spirit and scope of the disclosure. Examples of make-up air design parameters may include but are not limited make-up air discharge proximity to the hood, make-up air discharge velocity, make-up air introduction style and/or any other parameter associated with the introduction of make-up air into the kitchen hood system 32 that is not easily modified but yet has an impact on the overall efficiency of the kitchen hood system 32 that will be apparent to those skilled in the relevant art(s) without departing from the spirit and scope of the disclosure.

At step 320, the weighting module 140 may weight each parameter with each weight being associated with a predicted impact each parameter has on the overall efficiency that kitchen hood system 32 operates relative to each other parameter. As noted above, the impact that each parameter has on the overall efficiency may differ. The weighting module 140 may then assess the impact each parameter has on an individual basis on the overall efficiency and assign a weight accordingly. A parameter has a greater impact on the overall efficiency may be assigned a greater weight and a parameter that has a lesser impact on the overall efficiency may be assigned a lesser weight.

For example, a parameter that includes a canopy overhang may be weighted. The canopy overhang is the perimeter of the opening of the exhaust hood 34 that encompasses the cooking units 18 and is thus a physical aspect of the kitchen hood system 32 that is fixed and difficult to modify. The greater amount of overhang of the exhaust hood 34 and thus better encompassing the cooking units 18 results in less loss of the gaseous substance into the kitchen 12 as the exhaust hood 34 exhausts the gaseous substance away from the cooking units 18 resulting in improved overall efficiency of the kitchen hood system 32.

An exhaust hood 34 that fails to fully encompass the cooking units 18 may have a significant negative impact on the overall efficiency due to the immense amount of gaseous substance that escapes into the kitchen 12 as the exhaust hood 34 exhausts the gaseous substance. The immense amount of gaseous substance escaped into the kitchen requires the fan 50 operate at higher velocities in an attempt to exhaust the escaped gaseous substance back into the exhaust hood 34. Such an unnecessary increase in the velocity of the fan 50 due to the poor canopy overhang results in an unfavorable impact on the overall efficiency of the kitchen hood system 32.

However, an exhaust hood 34 that extends beyond the cooking units 18 greater than 12 inches may have a significant positive impact on the overall efficiency due to the minimal gaseous substance that escapes as the exhaust hood 34 exhausts the gaseous substance. The exhaust hood 34 that extends beyond the cooking units greater than 12 inches significantly reduces the amount of gaseous substance that is escaped into the kitchen 12 and thus maintains the gaseous substance within proximity of the exhaust hood 34. The minimal gaseous substance that escapes enables the fan 50 to operate at lower velocities due the majority of the gaseous substance being within close proximity of the exhaust hood 34 and thus results in a favorable impact on the overall efficiency of the kitchen hood system 32.

At step 330, the incorporation module 130 may incorporate the weight of each parameter into a reduction factor with the reduction factor being representative of an overall impact that the plurality of parameters has on the overall efficiency that the kitchen hood system 32 operates. Rather than determining what type of additional graduated actions should be executed based on the impact of each individual parameter on the overall efficiency, the reduction factor is generated to encompass the overall impact of the plurality of parameters on the overall efficiency. The greater amount of parameters that have positive individual impacts on the overall efficiency may result in a larger reduction factor. The greater amount of parameters that have negative individual impacts and/or minimal individual impacts on the overall efficiency may result in a lesser reduction factor.

For example, the hood style of the exhaust hood 34 may be a parameter that is a physical aspect of the exhaust hood 34 that is not typically modified. A proximate hood style is an exhaust hood 34 that has its opening relatively close to the cooking units 18, such a less than 4 feet from the cooking units 18. A proximate hood style that is relatively close to the cooking units 18 may prevent the gaseous substance from escaping the exhaust hood 34 and escaping into the kitchen 12 because there is less space between the exhaust hood 34 and the cooking units 18 for the gaseous substance to escape. Thus, the fan 50 may operate at a lower velocity with a proximate hood style due to having to compensate less for the escaped gaseous substance.

In such an example, the weighting module 140 may first weight the proximate hood style positively and then weight the canopy overhang that fails to encompass the cooking units 18 negatively. The incorporation module 130 may then incorporate the positive weight of the proximate hood style with the negative weight of the poor canopy overhang. In doing so, the incorporation module 130 may generate a reduction factor that represents the overall impact of the proximate hood style and the canopy overhang on the overall efficiency of the kitchen hood system 32.

In step 340, the adjustment module 150 may generate an additional graduated action, such as further adjusting the velocity of the fan 50, to optimize the energy savings associated with the kitchen hood system 32. After the control module 72 has executed graduated actions based on the volume of the gaseous substance located in the exhaust hood 34, the adjustment module 150 may generate additional graduated actions based on the reduction factor. As noted above, the reduction factor is representative of the overall impact of the parameters on the overall efficiency of the kitchen hood system 32. The adjustment module 150 may apply the reduction factor in executing the additional graduated actions so that even less unnecessary energy may be devoted to the exhaust of the gaseous substance resulting in optimal energy savings of the kitchen hood system 32.

For example, the reduction factor representing the proximate hood style and the poor canopy overhang may result in a negative reduction factor. Despite the proximate hood style having a positive impact on the overall efficiency of the kitchen hood system 32, the negative impact of the poor canopy overhang not only negates the positive impact provided by the proximate hood style but is greater than the positive impact provided by the proximate hood style. As a result, the incorporation module 130 may incorporate the negative reduction factor into any additional graduated actions.

For example, the incorporation module 130 may increase the velocity of the fan 50 from 80% to 83% despite the low volume of gaseous substance located in the exhaust hood 34. The incorporation module 130 may have to increase the velocity of the fan 50 to accommodate for the loss of the gaseous substance that escapes into the kitchen 12 due to the poor canopy overhang.

In an embodiment, the weight generated by weighting module 140 for each parameter may be representative of the impact that each parameter has on the overall efficiency of the kitchen hood system 32 relative to each other parameter. Each parameter may have a different impact on the overall efficiency relative to each other parameter. Some parameters may have a much more significant impact on the overall efficiency whether positive or negative as compared to the other parameters so that the weighting module 140 assigns a greater weight to those parameters accordingly. Other parameters may have a much less impact on the overall efficiency as compared to the other parameters so that the weighting module 140 assigns a lesser weight to those parameters accordingly.

For example, a parameter that includes side curtains may be weighted relative to each of the other parameters. Side curtains are curtains that extend from the opening of the exhaust hood 34 down to the surface of the cooking units 18 and are thus a physical aspect of the kitchen hood system 32 that is fixed and difficult to modify. The side curtains allow an operator to continue to engage the cooking units 18 while preventing the gaseous substance from escaping into the kitchen 12. The side curtains provide a shield that contains the gaseous substance within proximity of the exhaust hood 34 and has a significant positive impact on the capability of the fan 50 to exhaust the gaseous substance. Thus, the side curtains have a significant impact on the overall efficiency of the kitchen hood system 32 as compared to other parameters. As a result, the weighting module 140 may weight the parameter of side curtains greater than other parameters.

In another example, a parameter that includes the relative location of the exhaust hood 34 with regards to other exhaust hoods may be weighted relative to the other parameters. The exhaust hood 34 may be positioned with other exhaust hoods so that an exhaust hood may be positioned on both sides of the exhaust hood 34 resulting in a center location of the exhaust hood 34. The exhaust hood 34 may also be positioned in isolation from other exhaust hoods resulting in a dual open end exhaust hood. The exhaust hood 34 may also be positioned with a single exhaust hood positioned on a given side of the exhaust hood resulting in a single open end exhaust hood. Thus, the positioning of the exhaust hood 34 relative to other exhaust hoods is a physical aspect of the kitchen hood system 32 that is fixed and difficult to modify.

The exhaust hood 34 being in a center location with exhaust hoods positioned on both sides of the exhaust hood 34 does have a positive impact on the capability of the fan 50 to exhaust the gaseous substance. With additional exhaust hoods positioned on either side, the likelihood that any gaseous substance that escapes from the exhaust hood 34 is captured by the exhaust hoods positioned on either side is increased as compared to when no exhaust hoods are positioned on either side as in a dual open end exhaust hood 34. However, the overall impact on the overall efficiency of the kitchen hood system 32 with regards to whether the exhaust hood 34 is in a center location or is dual open ended is significantly less as compared to whether side curtains are positioned with the exhaust hood 34. Thus, the weighting module 140 may weight the side curtain parameter greater than the relative location parameter.

Figure 4:
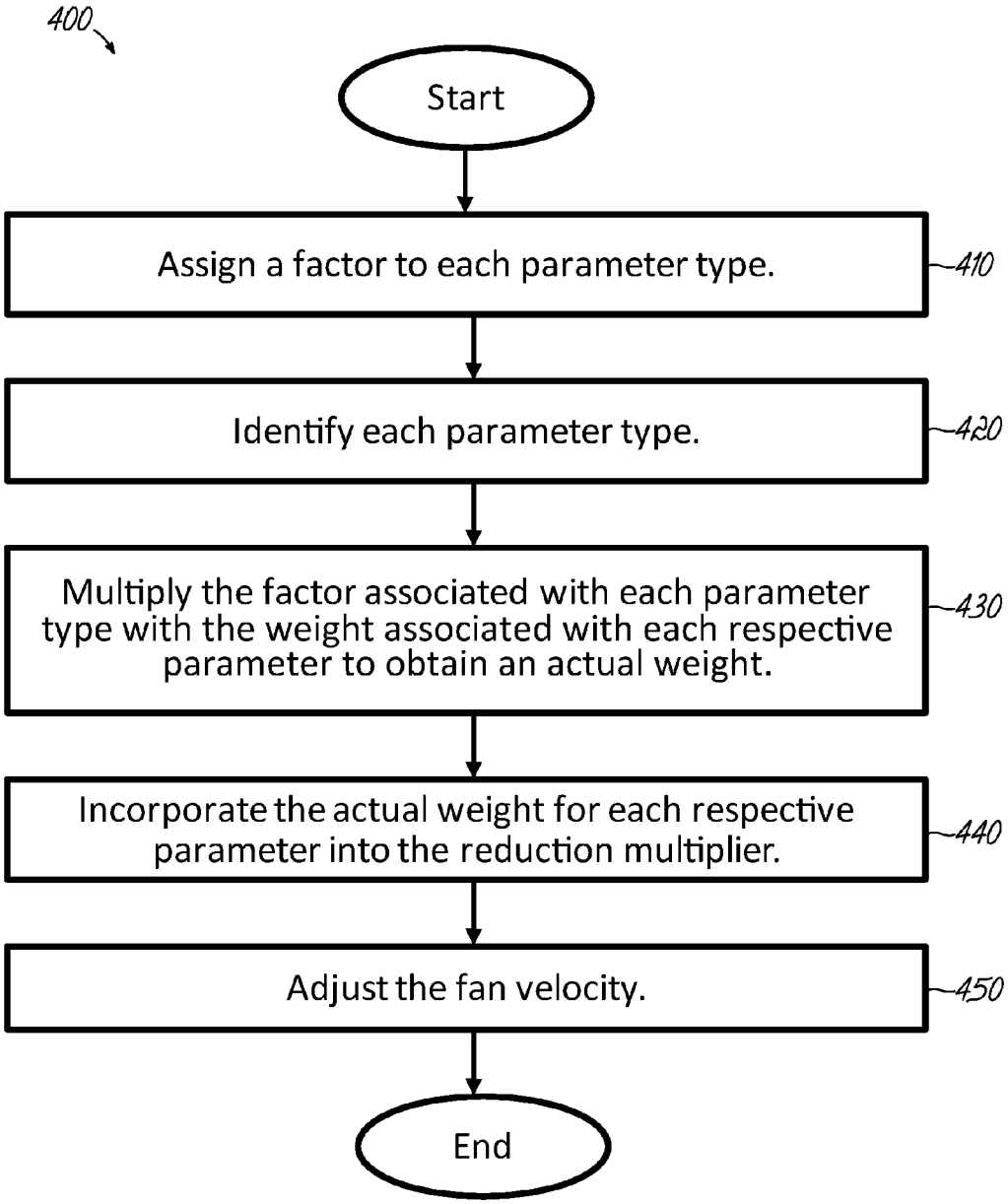
FIG. 4 is a flowchart showing an example method incorporating the impact that each parameter type associated with the kitchen hood system has on the overall efficiency of the kitchen hood system into the reduction factor.

Referring now to FIG. 4, a flowchart is presented showing an exemplary process 400 incorporating the impact that each parameter type associated with the kitchen hood system 32 has on the overall efficiency of the kitchen hood system 32 into the reduction factor. Each parameter associated with the kitchen hood system 32 may be categorized to include several different parameter types. The kitchen hood system 32 may have at least one parameter type from each parameter associated with it. The control module 72 may generate a more detailed reduction factor that not only takes into account the weight with regards to how each parameter relative to each other parameter impacts the overall efficiency but also the impact that each parameter type has on the overall efficiency as well.

As noted above, parameters may be fixed conditions specific to the kitchen hood system 32 that despite graduated actions executed by the control module 72 have an impact on the overall efficiency attained by the kitchen hood system 32. Each parameter may include several parameter types. The kitchen hood system 32 may include at least one parameter type from each parameter.

For example, with regards to the parameters associated with the physical aspects of the kitchen hood system 32, the hood style parameter may include the parameter types in which the hood style is island, canopy, and/or proximity. The canopy overhang parameter may include the parameter types in which the canopy overhang has a portion of the cooking units outside of the hood, less than 6" extension of the hood beyond the cooking units 18, 6"-12" extension of the hood beyond the cooking units 18, or greater than 12" extension of the hood beyond the cooking units 18. The hood depth parameter may include parameter types in which the hood depth of the opening of the exhaust hood 34 is less than 24", between 24"-34", or 36" or greater. The side curtain parameter may include parameter types of having side curtains or not having side curtains. The relative location parameter may include parameter types of dual open end, single open end, or a center location.

With regards to the parameters associated with the make-up air design parameters associated with the make-up aspects of the kitchen hood system 32, the make-up air discharge proximity to the hood parameter may include the parameter types of less than 6' or greater than 6'. The make-up air discharge velocity parameter may include the physical parameters of 300 feet per minute (fpm) or less than 300 fpm. The make-up air introduction style parameter may include the parameter types of short circuit, front face, front plenum, ceiling diffusers, rear plenum, and or transfer air. The parameter types may include any type of parameter type that is not easily modified but yet has an impact on the overall efficiency of the kitchen hood system 32 that will be apparent to those skilled in the relevant art(s) without departing from the spirit and scope of the disclosure.

In step 410, the weighting module 140 assigns a factor to each parameter type associated with each parameter with the factor being representative of the predicted impact that each parameter type has on the overall efficiency of the kitchen hood system 32. As noted above, the weighting module 140 assigns a weight to each parameter in which such a weight is representative of the impact that each parameter has on the overall efficiency relative to the impact that each other parameter has on the overall efficiency. The factor assigned to each parameter type captures the impact that each individual parameter type has on the overall efficiency of the kitchen hood system 32.

For example, the kitchen hood system 32 has a hood style parameter associated with it in which the kitchen hood system 32 may have a parameter style that includes an island hood style, a wall canopy hood style, or a proximity hood style. A kitchen hood system 32 that has an island hood style is positioned in kitchen 12 such that the kitchen hood system 32 is in the middle of space with all four sides of the kitchen hood system 32 open to space without any wall positioned on any side of the kitchen hood system 32. With an island hood style, the gaseous substance may travel 360 degrees around the kitchen hood system 32 because there is no barrier positioned on any side of the kitchen hood system 32 to aid in containing the gaseous substance. As a result, the fan 50 has to operate at higher velocities with the island hood style due to the escape of the gaseous substance into the kitchen 12 resulting in no impact in the overall efficiency of the kitchen hood system 32.

A kitchen hood system 32 that has a wall canopy hood style may have at least one side of the kitchen hood system 32 positioned next to a wall. With at least one side of the kitchen hood system 32 positioned next to a wall, the amount of gaseous substance that escapes into the kitchen 12 is significantly less as compared to the kitchen hood system 32 with an island hood style. As a result, the fan 50 has to operate at lower velocities due to the greater amount of gaseous substance located in the exhaust hood 34 resulting in a positive impact in the overall efficiency of the kitchen hood system 32. The weighting module 140 may then assign a more favorable factor to the kitchen hood system 32 that includes the wall canopy hood style than the kitchen hood system 32 that includes the island hood style due to the more favorable impact on the overall efficiency of the wall canopy hood style as compared to the island hood style.

An example of each factor (F) assigned to each parameter type can be seen in Table 700 of FIG. 7.

In step 420, the identification module 120 identifies each parameter type that is associated with the kitchen hood system 32. For example, the identification module 120 identifies the kitchen hood system 32 has having: a parameter type of wall canopy from the hood style parameter; a parameter type of a canopy overhang of 6"-12" from the canopy overhang parameter; a parameter type of a hood depth of 36" or greater from the hood depth parameter; a parameter type of having side curtains from the side curtain parameter; a parameter type of make-up air discharge proximity to the hood of less than 6" from the make-up air discharge proximity to the hood parameter; a parameter type of make-up air discharge velocity of less than 300 fpm from the make-up air discharge parameter; and a parameter type of transfer air from the make-up air introduction style parameter.

An example of each identified factor (F) associated with the kitchen hood system 32 and the factor (F) assigned to each identified parameter type can be seen in Table 800 of FIG. 8.

In step 430, the weighting module 140 multiplies the factor associated with each identified parameter type with the weight associated with each respective parameter that each identified parameter type is associated with to obtain an actual weight of each respective parameter. The weighting module 140 not only incorporates the impact that each parameter type has on the overall efficiency of the kitchen hood system 32 but that impact is scaled based on the weight associated with the parameter that includes the parameter type. As a result, an actual weight that represents the impact that the individual parameter type has on the overall efficiency but that impact is scaled to account for the impact that the parameter has on the kitchen hood system 32 relative to each other parameter.

The overall weight prevents a parameter type that has a high factor assigned to it based on its positive impact on the overall efficiency of the kitchen hood system 32 from inaccurately inflating the reduction factor due to a lesser overall impact of the corresponding parameter as compared to other parameters. Without scaling the impact of the parameter type based on the relative impact of its corresponding parameter relative to other parameters, the parameter type may skew the reduction factor so that the reduction factor may represent a more positive impact of the parameter types and corresponding parameters than is actually the case. A skewed reduction factor may result in the adjustment module 150 further decreasing the velocity of the fan 50 when in fact the fan 50 is required to operate at a higher velocity to adequately exhaust the gaseous substance from the exhaust hood 34.

For example, Table 800 in FIG. 8 depicts that the kitchen hood system 32 includes a canopy overhang of 6"-12" as well as a hood depth of 36" or greater. The canopy overhang of 6"-12" indicates that the perimeter of the exhaust hood 34 extends beyond the cooking units 18 by 6"-12" and has a moderate impact in reducing the amount of gaseous substance that escapes out into the kitchen 12 resulting in a factor of "1" being assigned to it. The hood depth of 36" or greater is the largest hood depth that may be included in an exhaust hood 34 in that the opening of the exhaust hood 34 has its largest volume to contain the gaseous substance within the exhaust hood 34 during the exhaust of the gaseous substance. As a result, the hood depth of 36" or greater has a significant impact in reducing the amount of gaseous substance that escapes into the kitchen 12 resulting in a factor of "2" being assigned to it.

However, the impact of the of the canopy overhang parameter on the overall efficiency of the kitchen hood system 32 is greater than the impact of the hood depth parameter. As a result, the canopy overhang parameter is assigned a weight of "2" and the hood depth parameter is assigned a weight of "1". Regardless of whether the kitchen hood system 32 includes the most efficient hood depth of 36" or greater, the overall impact of such a hood depth on the overall efficiency may be similar to the overall impact of a moderately efficient canopy overhang of 6"-12".

The weighting module 430 then multiplies the factor of "1" assigned to the 6"-12" parameter type with the weight of "2" assigned to the canopy overhang parameter to obtain an actual weight of "2" associated with the canopy overhang parameter for the kitchen hood system 32. The weighting module 430 also multiplies the factor of "2" assigned to the 36" or greater parameter type with the weight of "1" assigned to the hood depth parameter to obtain an actual weight of "2" associated with the hood depth parameter for the kitchen hood system 32. Thus, the actual weight of "2" associated with the most efficient hood depth parameter type of 36" or greater is the same as the actual weight of "2" associated with a moderate canopy overhang type of 6"-12" indicating that the overall impact on the overall efficiency of each is substantially the same.

In step 440, the incorporation module 130 incorporates the actual weight for each respective parameter into the reduction multiplier. Rather than determining what type of additional graduated actions should be executed based on the impact of each individual parameter type on the overall efficiency, the reduction factor is generated to scale the impact of each individual parameter type based on the impact of the corresponding parameters.

The incorporation of the actual weight for each respective parameter into the reduction multiplier prevents the reduction multiplier from being inaccurately skewed. The actual weights represent the impact that each parameter has on the overall efficiency relative to each other parameter as well as the impact that each individual parameter type has on the overall efficiency. As a result, the generation of a skewed reduction multiplier that is inflated due to a parameter type that has a high factor but is associated with a parameter that has a lesser impact on the overall efficiency of the kitchen hood system 32 is prevented. For example, a parameter type with a high factor, such as the 36" or greater hood depth parameter type due such a hood depth parameter type being the most efficient hood depth parameter type, is scaled back due the lesser impact of the hood depth parameter has on the overall efficiency relative to other parameters, such as the canopy overhang.

In step 450, the adjustment module 150 may generate an additional graduated action, such as further adjusting the velocity of the fan 50, that accounts for not only the impact of each individual parameter type but the relative impact of each corresponding parameter. The adjustment module 150 may apply such a reduction factor to execute additional graduated actions that properly accommodates for the impact of each parameter type.

For example, a reduction factor that weights the parameter type of a 6"-12" canopy overhang and the parameter type of 36" or greater hood depth without accommodating for the relative impact of each of the canopy overhang and hood depth parameters results in an adjustment of the velocity of the fan 50 from 80% to 77%. Such a reduction factor directly incorporates the factor of "1" assigned to the canopy overhang of 6"-12" and the factor of "2" assigned to the hood depth of 36" or greater without scaling back the overall impact of the hood depth relative to the canopy overhang.

However, a reduction factor that includes the overall weights for the canopy overhang and the hood depth results in an adjustment of the velocity of the fan 50 from 80% to 78%. Despite the hood depth of 36" or greater having a factor of "2", the relative impact of such a hood depth is less than the impact of the canopy overhang. As a result, the velocity of the fan 50 cannot be decreased from 80% to 77% while adequately exhausting the gaseous substance. Such a decrease represents an inflated reduction factor that inaccurately accounts for the impact of the hood depth of 36". Rather, a reduction factor in which the impact of the hood depth of 36" is scaled relative to the overall impact provided by the hood depth parameter, reduces the velocity of the fan 50 from 80% to 78% so that the fan 50 still adequately exhausts the gaseous substance while reducing the amount of energy devoted to the exhaust.

Figure 5:
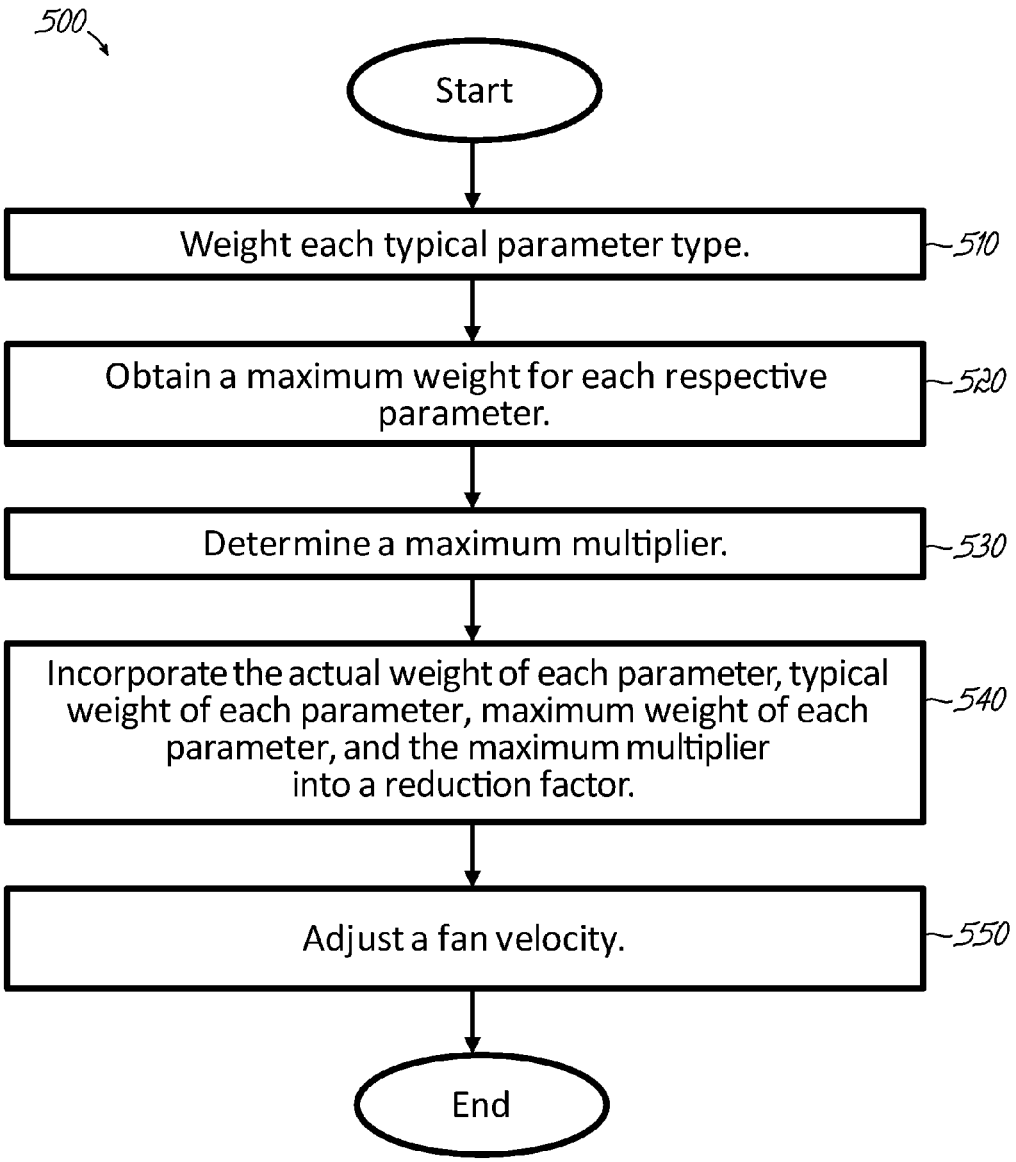
FIG. 5 is a flowchart showing an example method for adjusting the velocity of the fan based on additional characteristics associated with the parameters of the kitchen hood system to further improve the overall efficiency.

Referring now to FIG. 5, a flowchart is presented showing an exemplary process 500 by which the adjustment module 150 may adjust the velocity of the fan 50 based on additional characteristics associated with the parameters of the kitchen hood system 32 to further improve the overall efficiency. Other characteristics associated with the parameters of the kitchen hood system 32, such as a parameter type that is typically used in kitchen hood systems, the parameter type with the largest factor, as well as a maximum multiplier that caps the impact that the reduction factor may have on the additional graduated actions may provide further improvement to the overall efficiency of the kitchen hood system 32.

In step 510, a typical parameter type associated with each parameter is selected and weighted by the weighting module 140. A typical parameter type is the parameter type that is most often found in kitchen hood systems that are similar to the kitchen hood system 32. The typical parameter type is the parameter type with the highest quantity as compared to the other parameter types associated with the respective parameter that are found in typical kitchen hood systems. The weighting module 140 may then weight the typical parameter type in a similar fashion as the weighting module 140 weights the parameter type actually associated with the kitchen hood system 32. The weighting module 140 may multiply the factor of the typical parameter type with the weight of the corresponding parameter to obtain the typical weight. This is similar to the weighting module 140 multiplying the factor of the actual parameter type associated with the kitchen hood system 32 with the weight of the corresponding parameter to obtain the actual weight.

The weighting module 140 may then incorporate the typical weight associated with each parameter into the reduction factor. By incorporating the typical weight associated with each parameter into the reduction factor, the discrepancy between the actual weight of each parameter for the kitchen hood system 32 and the typical weight of each parameter for a typical kitchen hood system may be accounted for. The discrepancy between the actual weight and the typical weight of each parameter represents the additional positive and/or negative impact of each actual parameter on the overall efficiency of the kitchen hood system 32 as compared to that of typical kitchen hood systems.

For example, as shown in Table 700 in FIG. 7, the make-up air discharge proximity to hood parameter has a typical parameter type of less than 6' as represented by the typical weight (T) of "0" in Table 700. The typical weight (T) of "0" is generated by multiplying the factor of "0" for the less than 6' parameter type with the weight (W) of "1" for the make-up air discharge proximity to hood parameter.

The make-up air discharge proximity to hood parameter is the location relative to the exhaust hood 34 in which the make-up air is introduced as the exhaust hood 34 exhausts the gaseous substance. The closer to the exhaust hood 34 that the make-up air is introduced to the exhaust hood 34 the greater the negative impact on the exhausting of the gaseous substance. The fan 50 has to exhaust the make-up air in addition to the gaseous substance when the make-up air is introduced within 6' of the exhaust hood 34, thus causing the velocity of the fan 50 to be increased resulting in a negative impact on the overall efficiency of the kitchen hood system 32.

However, the actual parameter type associated with the kitchen hood system 32 as shown in Table 800 in FIG. 8 for the make-up air discharge proximity to hood parameter is greater than 6'. The factor associated with the greater than 6' parameter type is "1" as compared to the typical factor of "0" associated with the less than 6' parameter type. The impact of the actual parameter type of greater than 6' results in a significant positive impact on the overall efficiency of the kitchen hood system 32 as compared to the negative impact that the typical less than 6' parameter type has on the typical kitchen hood system. As result, the actual weight of the greater than 6' parameter type of "1" is greater than the typical weight of "0" of the less than 6' parameter type.

In step 520, the largest parameter type associated with each parameter is selected and weighted by the weighting module 140. The largest parameter type is the parameter type with the largest factor for each parameter. The largest parameter type is the parameter type with the largest factor that could be found in any kitchen hood system. There is no parameter type that exists in a kitchen hood system with a larger factor than the largest parameter type. The weighting module 140 may then weight the largest parameter type by multiplying the factor associated with the largest parameter type with the weight associated with the corresponding parameter of the largest parameter type to generate a maximum weight for the parameter.

The weighting module 140 may then incorporate the maximum weight associated with each parameter into the reduction factor. The maximum weight is representative of an optimal kitchen hood system that includes a parameter type for each parameter that has the greatest positive impact on the overall efficiency of the optimal kitchen hood system. The optimal kitchen hood system includes each and every parameter type that results in optimal efficiency. Regardless of the combination of actual parameter types included in the kitchen hood system 32, the overall impact on the overall efficiency of the kitchen hood system 32 cannot extend beyond what is represented by the maximum weight. As a result, the overall efficiency of any kitchen hood system, including kitchen hood system 32, may be capped by the maximum weight.

For example, as shown in Table 700 in FIG. 7, the make-up air discharge velocity parameter has a maximum parameter type of less than 300 fpm as represented by the maximum weight (M) of "2" in Table 700. The maximum weight (M) of "2" is generated by multiplying the factor of "1" for the less than 300 fpm parameter type with the weight (W) of "2" for the make-up air discharge velocity parameter.

The make-up air discharge velocity parameter is the velocity in which the make-up air is introduced into the kitchen 12 as the exhaust hood 34 exhausts the gaseous substance. The faster the velocity in which the make-up is introduced, the greater the negative impact on the exhausting of the gaseous substance. The fan 50 has to exhaust the make-up air at a faster rate in addition to the gaseous substance when the make-up air is introduced at a velocity that is greater than 300 fpm, thus causing the velocity of the fan 50 to be increased resulting in a negative impact on the overall efficiency of the kitchen hood system 32. The greatest positive impact that the make-up air discharge velocity parameter can have on any kitchen hood system is a kitchen hood system that includes a parameter type of less than 300 fpm. As a result, the overall efficiency of any kitchen hood system with regards to the make-up air discharge velocity parameter is capped by the maximum weight of "2".

In step 530, the identification module 120 determines a maximum multiplier that limits the impact that the parameters have on the overall efficiency of the kitchen hood system 32. As noted above, initial graduated actions are executed by the control module 72 based on the feedback provided by the temperature sensor 76 as well as the gaseous substance sensor 82. The significant impact on the overall efficiency of the kitchen hood system 32 is obtained based on the volume of gaseous substance located in the exhaust hood 34. The feedback provided by the temperature sensor 76 and the gaseous substance sensor 82 is indicative of the volume of the gaseous substance located in the exhaust hood 34.

Additional impact on the overall efficiency of the kitchen hood system 32 is obtained based on the positive and/or negative impact of the parameters associated with the kitchen hood system 32. The additional graduated actions generated based on the parameters supplement the initial graduated actions already executed by the control module 72 that are based on the volume of the gaseous substance located in the exhaust hood 34. The additional graduated actions incrementally improve the overall efficiency. For example, the initial graduated action includes reducing the velocity of the fan 50 to 80% based on the volume of the gaseous substance located in the exhaust hood 34. The additional graduated action includes reducing the velocity of the fan 50 to 77% based on the favorable impact of the parameters.

The maximum multiplier is a constant that limits the impact that the parameters can have on the overall efficiency of the kitchen hood system 32. After all of the parameters have been weighted, the parameter types identified, as well as the typical weight, actual weight, and maximum weights have been determined, the impacts these have on the reduction factor are limited by the maximum multiplier. For example, the maximum multiplier is 0.15 indicating that the maximum impact that the parameters can have on the overall efficiency is 15%. The analysis used to generate the reduction factor associated with the parameters cannot exceed impacting the overall efficiency beyond 15%.

In step 540, the incorporation module 130 incorporates the actual weight of each parameter, the typical weight of each parameter, the maximum weight of each, and the maximum multiplier into a reduction factor. The actual weight, the typical weight, the maximum weight, and the maximum multiplier have been discussed in detail above with regards to their importance in being incorporated into the reduction factor. The incorporation module 130 may incorporate each into the reduction factor in the following manner.

Each actual weight of each parameter may be summed together to generate a total actual weight for the kitchen hood system 32. The total actual weight may be determined as follows:

$$\text{Total Actual Weight}=(F_1*W_1)+(F_2*W_2)+(F_3*W_3)+(F_4*W_4)+(F_5*W_5)+(F_6*W_6)+(F_7*W_7)+(F_8*W_8). \quad (1)$$

The total actual weight of the kitchen hood system 32 as depicted in Table 8 of FIG. 8 is:

$$\text{Total Actual Weight}=(1*1)+(1*2)+(2*1)+(2*2)+(1*1)+(1*1)+(1*2)+(2*2). \quad (2)$$

So that the total actual weight for the kitchen hood system is:

$$\text{Total Actual Weight}=17. \quad (3)$$

Each typical weight of each parameter may be summed together to generate a total typical weight for the kitchen hood system 32. The total typical weight may be determined as follows:

$$\text{Total Typical Weight}=(T_1*W_1)+(T_2*W_2)+(T_3*W_3)+(T_4*W_4)+(T_5*W_5)+(T_6*W_6)+(T_7*W_7)+(T_8*W_8). \quad (4)$$

The total typical weight of the kitchen hood system 32 as depicted in Table 7 of FIG. 7 is:

$$\text{Total Typical Weight}=(1*1)+(1*2)+(1*1)+(1*2)+(1*1)+(0*1)+(0*2)+(1*2). \quad (5)$$

So that the total typical weight for the kitchen hood system is:

$$\text{Total Typical Weight}=9. \quad (6)$$

Each maximum weight of each parameter may be summed together to generate a total maximum weight for the kitchen hood system 32. The total maximum weight may be determined as follows:

$$\text{Total Maximum Weight}=(M_1*W_1)+(M_2*W_2)+(M_3*W_3)+(M_4*W_4)+(M_5*W_5)+(M_6*W_6)+(M_7*W_7)+(M_8*W_8). \quad (7)$$

The total maximum weight of the kitchen hood system 32 as depicted in Table 7 of FIG. 7 is:

$$\text{Total Maximum Weight}=(2*1)+(2*2)+(2*1)+(2*2)+(2*1)+(1*1)+(1*2)+(2*2). \quad (8)$$

So that the total maximum weight for the kitchen hood system is:

$$\text{Total Maximum Weight}=21. \quad (9)$$

The reduction factor may then be determined based on the following equation:

$$(\text{Maximum Multiplier/Number of Parameter Sets})*[(\text{Total Actual Weight}-\text{Total Typical Weight})/(\text{Total Maximum Weight})]. \quad (10)$$

Using the examples depicted in Table 700 of FIG. 7 and Table 800 of FIG. 8, the following equation is generated to determine the reduction factor for the kitchen hood system 32:

$$\text{Reduction Factor}=(0.15/2)*[(17-9)/21)], \quad (11)$$

$$\text{Reduction Factor}=0.028. \quad (12)$$

The maximum multiplier is the constant in which the impact on the overall efficiency is limited and is set at 0.15 for this example. The number of parameter sets is the quantity of different parameter sets that are incorporated into the kitchen hood system 32. In this example, the different parameter sets include the physical characteristic parameters and the make-up air design parameters so that the number of parameter sets is equal to "2". The total actual weight, total typical weight and total maximum weight are obtained from equations 3, 6, and 9, respectively.

In step 550, the adjustment module 150 adjusts the velocity of the fan 50 from a pre-determined velocity to an optimized fan velocity based on the reduction factor to optimize the overall efficiency of the kitchen hood system 32. As noted above, the velocity of the fan 50 may be initially adjusted by the control module 72 to a pre-determined velocity based on the volume of the gaseous substance located in the exhaust hood 34. The velocity of the fan 50 may then be further adjusted to an optimized fan velocity based on the reduction factor. The optimized fan velocity is then the velocity of the fan 50 in which optimal efficiency of the kitchen hood system 32 is attained resulting in optimal energy savings.

The optimal fan velocity may be determined based on the equation:

$$\text{Optimal Fan Velocity}=1-[(1-\text{Pre-Determined Fan Velocity Reduction})*(\text{Reduction Multiplier})]. \quad (13)$$

The pre-determined fan velocity reduction is the initial reduction in the velocity of the fan 50 based on the volume of the gaseous substance located in the exhaust hood 34 which in this example is 80%. The reduction factor is the reduction factor calculated in equation 12 summed with 1 as shown below:

$$\text{Reduction Multiplier}=1+\text{Reduction Factor}, \quad (14)$$

$$\text{Reduction Multiplier}=1+0.028. \quad (15)$$

The optimal fan velocity for this example is:

$$\text{Optimal Fan Velocity}=1-[(1-0.8)*(1.028)], \quad (16)$$

$$\text{Optimal Fan Velocity}=0.79. \quad (17)$$

Thus in this example, the adjustment module 150 may further adjust the velocity of the fan 50 from 80% to 79% based on the impact that the parameters have on the overall efficiency of the kitchen hood system 32.

Figure 6:
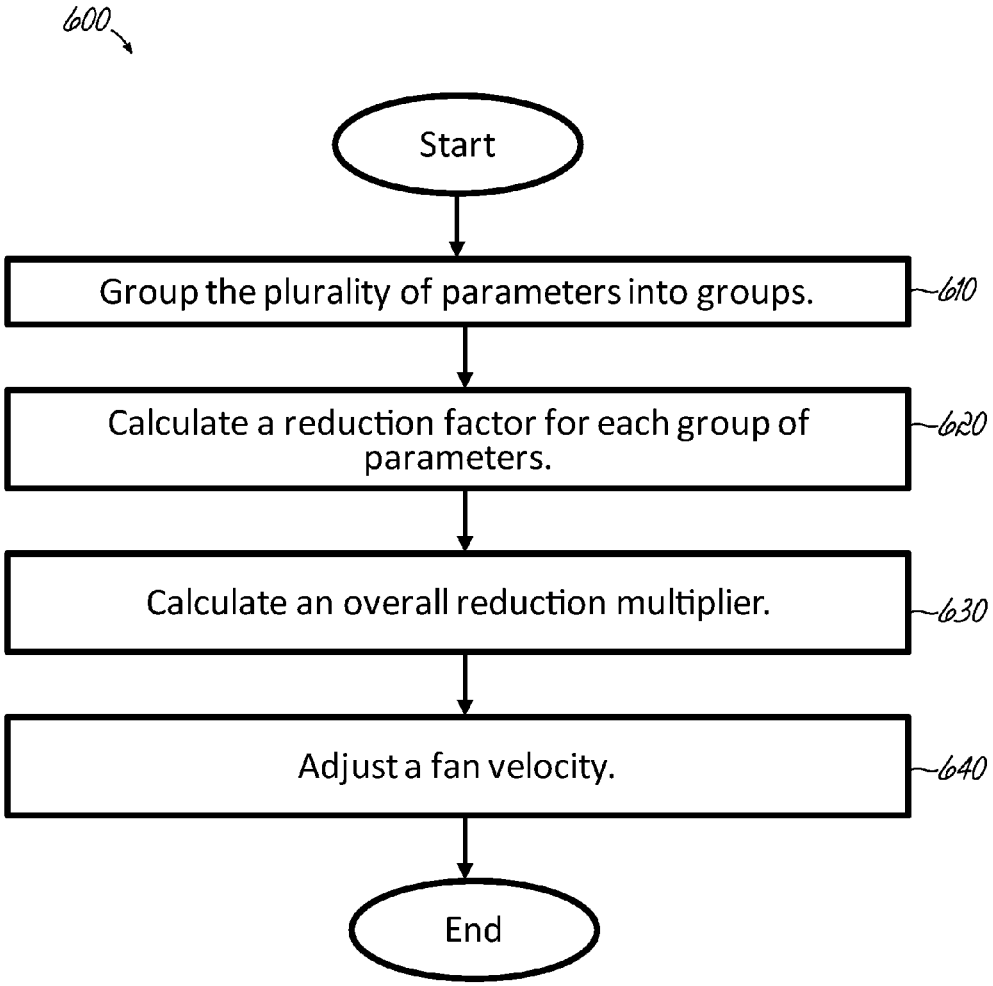
FIG. 6 is a flowchart showing an example method for generating a single reduction multiplier based on several reduction factors where each reduction factor is associated with a parameter group.

Referring now to FIG. 6, a flowchart is presented showing an exemplary process 600 that generates a single reduction multiplier based on several reduction factors where each reduction factor is associated with a parameter group. The parameters associated with the kitchen hood system 32 may be incorporated into parameter groups based on similar characteristics associated with each of the parameters. As noted above as an example, a parameter group may include physical parameters that include physical characteristics of the kitchen hood system 32. A parameter group may also include make-up air design parameters that include characteristics of how make-up air is introduced to the kitchen hood system 32. Parameter groups may include any set of parameters with similar characteristics of the kitchen hood system 32 that will be apparent to those skilled in the relevant art(s) without departing from the spirit and scope of the disclosure.

The type of impact on the overall efficiency of the parameters included in a first parameter group, such as the physical parameter group, as compared to the parameters included in a second parameter group, such as the make-up air design parameter group may differ significantly. Although the actual weight of each parameter in the physical parameter group may not differ significantly from the actual weight of the make-up design parameter group, the type of impact does indeed differ. The type of impact generated by the physical parameter group is based on the physical characteristics of the kitchen hood system 32 while the type of impact generated by the make-up air design parameters is based on how make-up air is introduced to the kitchen hood system 32.

Rather than accumulating the different impacts of different parameter groups into a single reduction factor, the type of impacts may more accurately be portrayed with individual reduction factors generated for each parameter group. As a result, a first individual reduction factor representative of the overall impact of a first parameter group, such as the physical parameter group, and a second individual factor representative of the overall impact of a second group, such as the make-up air design parameter group, may more accurately portray the individual impacts on the overall efficiency of each group.

In step 610, the identification module 120 groups each of the parameters into at least two groups with each group having similar characteristics as each other. As discussed in detail above, the parameters associated with the kitchen hood system 32 may have similar characteristics with each other and can be grouped together into a parameter group accordingly. For example as shown in Table 800 in FIG. 8, the parameters of hood style, canopy overhang, hood depth, side curtains, and relative location are all parameters that are associated with the physical characteristics of the kitchen hood system 32. Due to the similar physical characteristics of these parameters, the identification module 120 groups these parameters into the physical parameter group. The parameters of make-up air discharge proximity to hood, make-up air discharge velocity, and the make-up air introduction style parameters are all parameters associated with the make-up characteristics of the kitchen hood system 32 and are thus grouped into the make-up air design parameter group.

In step 620, the incorporation module 130 calculates a reduction factor for each group of parameters. As noted above, the type of impact on the overall efficiency of the kitchen hood system 32 by the different parameter groups may differ significantly. As a result, the calculation of a reduction factor for each parameter group may account for the different types of impacts that each of the parameter groups have on the overall efficiency of the kitchen hood system 32.

For example as in Table 800 in FIG. 8, the reduction factor for the physical parameter group and the reduction factor for the make-up air design parameter group may be determined as follows. Each actual weight of each parameter in the physical parameter group may be summed together to generate a total actual weight for the physical parameter group. The total actual weight for the physical parameter group may be determined as follows:

$$\text{Total Actual Weight}=(F_1*W_1)+(F_2*W_2)+(F_3*W_3)+(F_4*W_4)+(F_5*W_5). \quad (18)$$

The total actual weight for the physical parameter group as depicted in Table 800 of FIG. 8 is:

$$\text{Total Actual Weight}=(1*1)+(1*2)+(2*1)+(2*2)+(1*1). \quad (19)$$

So that the total actual weight for the kitchen hood system is:

$$\text{Total Actual Weight}=10. \quad (20)$$

Each typical weight for each parameter in the physical parameter group may be summed together to generate a total typical weight for the physical parameter group. The total typical weight for the physical parameter group may be determined as follows:

$$\text{Total Typical Weight}=(T_1*W_1)+(T_2*W_2)+(T_3*W_3)+(T_4*W_4)+(T_5*W_5). \quad (21)$$

The total typical weight for the physical parameter group as depicted in Table 700 of FIG. 7 is:

$$\text{Total Typical Weight}=(1*1)+(1*2)+(1*1)+(1*2)+(1*1). \quad (22)$$

So that the total typical weight for the physical parameter group is:

$$\text{Total Typical Weight}=7. \quad (23)$$

Each maximum weight for each parameter in the physical parameter group may be summed together to generate a total maximum weight for the physical parameter group. The total maximum weight for the physical parameter group may be determined as follows:

$$\text{Total Maximum Weight}=(M_1*W_1)+(M_2*W_2)+(M_3*W_3)+(M_4*W_4)+(M_5*W_5). \quad (24)$$

The total maximum weight for the physical parameter group as depicted in Table 700 of FIG. 7 is:

$$\text{Total Maximum}=(2*1)+(2*2)+(2*1)+(2*2)+(2*1). \quad (25)$$

So that the total maximum weight for the physical parameter group is:

$$\text{Total Maximum Weight}=14. \quad (26)$$

The reduction factor for the physical parameter group may then be determined based on the following equation:

$$\text{Reduction Factor}=(\text{Maximum Multiplier/Number of Parameter Sets})*[(\text{Total Actual Weight}-\text{Total Typical Weight})/(\text{Total Maximum Weight})]. \quad (27)$$

Using the examples depicted in Table 700 of FIG. 7 and Table 800 of FIG. 8, the following equation is generated to determine the reduction factor for the kitchen hood system 32:

$$\text{Reduction Factor}=(0.15/2)*[(10-7)/14)], \quad (28)$$

$$\text{Reduction Factor}=0.016. \quad (29)$$

The maximum multiplier is the constant in which the impact on the overall efficiency is limited and is set at 0.15 for this example. The number of parameter sets is the quantity of different parameter sets that are incorporated into the kitchen hood system 32. In this example, the different parameter sets include the physical characteristic parameters and the make-up air design parameters so that the number of parameter sets is equal to "2". The total actual weight, total typical weight and total maximum weight are obtained from equations 20, 23, and 26, respectively.

The reduction factor for the make-up air design parameter group may be determined as follows: Each actual weigh of each parameter in the make-up air design parameter group may be summed together to generate a total actual weight for the make-up air design parameter group. The total actual weight for the make-up air design parameter group may be determined as follows:

$$\text{Total Actual Weight}=(F_1*W_1)+(F_2*W_2)+(F_3*W_3). \quad (30)$$

The total actual weight for the make-up air design parameter group as depicted in Table 800 of FIG. 8 is:

$$\text{Total Actual Weight}=(1*1)+(1*2)+(2*2). \quad (31)$$

So that the total actual weight for the make-up air design parameter group is:

$$\text{Total Actual Weight}=7. \quad (32)$$

Each typical weight for each parameter in the make-up air design parameter group may be summed together to generate a total typical weight for the make-up air design parameter group. The total typical weight for the make-up air design parameter group may be determined as follows:

$$\text{Total Typical Weight}=(T_1*W_1)+(T_2*W_2)+(T_3*W_3). \quad (33)$$

The total typical weight for the make-up air design parameter group as depicted in Table 700 of FIG. 7 is:

$$\text{Total Typical Weight}=(0*1)+(0*2)+(1*2). \quad (34)$$

So that the total typical weight for the make-up air design parameter group is:

$$\text{Total Typical Weight}=2. \quad (35)$$

Each maximum weight for each parameter in the make-up air design parameter group may be summed together to generate a total maximum weight for the make-up air design parameter group. The total maximum weight for the make-up air design parameter group may be determined as follows:

$$\text{Total Maximum Weight}=(M_1*W_1)+(M_2*W_2)+(M_3*W_3). \quad (36)$$

The total maximum weight for the make-up air design parameter group as depicted in Table 700 of FIG. 7 is:

$$\text{Total Maximum Weight}=(1*1)+(1*2)+(2*2). \quad (37)$$

So that the total maximum weight for the make-up air design parameter group is:

$$\text{Total Maximum Weight}=7. \quad (38)$$

The reduction factor for the make-up air design parameter group may then be determined based on the following equation:

$$\text{Reduction Factor}=(\text{Maximum Multiplier/Number of Parameter Sets})*[(\text{Total Actual Weight}-\text{Total Typical Weight})/(\text{Total Maximum Weight})]. \quad (39)$$

Using the examples depicted in Table 700 of FIG. 7 and Table 800 of FIG. 8, the following equation is generated to determine the reduction factor for the make-up air design parameter group:

$$\text{Reduction Factor}=(0.15/2)*[(9-2)/5)], \quad (40)$$

$$\text{Reduction Factor}=0.054. \quad (41)$$

The maximum multiplier is the constant in which the impact on the overall efficiency is limited and is set at 0.15 for this example. The number of parameter sets is the quantity of different parameter sets that are incorporated into the kitchen hood system 32. In this example, the different parameter sets include the physical characteristic parameters and the make-up air design parameters so that the number of parameter sets is equal to "2". The total actual weight, total typical weight and total maximum weight for the make-up air design parameter group are obtained from equations 32, 35, and 38, respectively.

In step 630, the incorporation module 130 calculates an overall reduction multiplier for the kitchen hood system 32 that incorporates each reduction factor associated with each of the parameter groups. The overall reduction factor represents the overall adjustment to the already implemented graduated actions to further improve the overall efficiency of the kitchen hood system 32 due to the parameters. The overall reduction multiplier takes into the account the different impacts that each of the parameter groups has on the overall efficiency with the incorporation of each of the reduction factors while still providing an overall multiplier so that the additional graduated actions may be easily determined by implementing the overall multiplier.

The overall multiplier may be determined by summing each of the reduction factors for each parameter group with "1" as shown by:

$$\text{Reduction Multiplier}=1+(\text{First Parameter Group Reduction Factor})+(\text{Second Parameter Group Reduction Factor}). \quad (42)$$

For example as shown in Table 800 of FIG. 8, the reduction multiplier is determined as:

$$\text{Reduction Multiplier}=1+(0.016)+(0.054), \quad (43)$$

to generate a reduction multiplier of 1.070.

The reduction factor for the physical parameter group of 0.016 was generated from equation 29 and the reduction factor for the make-up air design parameter group of 0.054 was generated from equation 41.

In step 640, the adjustment module 150 adjusts the velocity of the fan 50 from a pre-determined velocity to an optimized fan velocity based on the reduction multiplier to optimize the overall efficiency of the kitchen hood system 32. As noted above, the velocity of the fan 50 may be initially adjusted by the control module 72 to a pre-determined velocity based on the volume of the gaseous substance located in the exhaust hood 34. The velocity of the fan 50 may then be further adjusted to an optimized fan velocity based on the reduction multiplier. The optimized fan velocity is then the velocity of the fan 50 in which optimal efficiency of the kitchen hood system 32 is attained resulting in optimal energy savings.

The optimal fan velocity may be determined based on the equation:

$$\text{Optimal Fan Velocity}=1-[(1-\text{Pre-Determined Fan Velocity Reduction})*(\text{Reduction Multiplier})]. \quad (44)$$

The pre-determined fan velocity reduction is the initial reduction in the velocity of the fan 50 based on the volume of the gaseous substance located in the exhaust hood 34 which in this example is 80%. The optimal fan velocity for this example is:

$$\text{Optimal Fan Velocity}=1-[(1-0.8)*(1.070)], \quad (45)$$

$$\text{Optimal Fan Velocity}=0.78. \quad (46)$$

Thus in this example, the adjustment module 150 may further adjust the velocity of the fan 50 from 80% to 78% based on the impact that the parameters have on the overall efficiency of the kitchen hood system 32.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details of the representative apparatus and method, and illustrative examples shown and described. Accordingly, departures may be made from such details without departing from the spirit or scope of applicants' general inventive concept.

What is claimed is:

1. A computer implemented method for optimizing energy savings associated with a kitchen hood system, comprising:

identifying a plurality of parameters associated with the kitchen hood system, wherein each parameter is a fixed condition specific to the kitchen hood system and has an impact on an overall efficiency that the kitchen hood system operates;

weighting each parameter, wherein the weight associated with each parameter is representative of a predicted impact each parameter has on the overall efficiency that the kitchen hood system operates relative to each other parameter;

incorporating the weight of each parameter into a reduction factor, wherein the reduction factor is representative of an overall impact that the plurality of parameters has on the overall efficiency that the kitchen hood system operates; and adjusting a fan velocity for each fan included in the kitchen hood system based on the reduction factor to optimize the energy savings associated with the kitchen hood system.

2. The computer implemented method of claim 1, further comprising:

assigning a factor to each parameter type associated with each parameter, wherein each parameter type is a different implementation associated with each respective parameter and the factor associated with each parameter type is representative of the predicted impact that each parameter type has on the overall efficiency that the kitchen hood system operates.

3. The computer implemented method of claim 2, further comprising:

identifying each parameter type that is associated with the kitchen hood system;

multiplying the factor associated with each identified parameter type with the weight associated with each respective parameter that each identified parameter type is associated with to obtain an actual weight for each respective parameter;

incorporating the actual weight for each respective parameter into the reduction factor; and adjusting the fan velocity for each fan included in the kitchen hood system based on the reduction factor to optimize the energy savings associated with the kitchen hood system.

4. The computer implemented method of claim 3, further comprising:

selecting a typical parameter type associated with each parameter, wherein the typical parameter type is the parameter type that is typically associated with the kitchen hood system; and weighting each selected typical parameter type associated with each parameter, wherein a typical weight associated with each typical parameter type is representative of the predicted impact each typical parameter type has on the overall efficiency that the kitchen hood system operates.

5. The computer implemented method of claim 4, further comprising:

selecting a largest parameter type associated with each parameter, wherein the largest parameter type is the parameter type associated with a largest factor for each respective parameter; and multiplying the largest factor associated with the largest parameter type with the weight associated with each respective parameter that each largest parameter type is associated with to obtain a maximum weight for each respective parameter.

6. The computer implemented method of claim 5, further comprising:

adding each actual weight for each respective parameter to obtain a total actual weight;

adding each typical weight for each selected typical parameter type to obtain a total typical weight; and adding each maximum weight for each respective parameter to obtain a maximum weight.

7. The computer implemented method of claim 6, further comprising:

determining a maximum multiplier, wherein the overall impact that the plurality of parameters has on the overall efficiency that the kitchen hood system operates as represented by the reduction multiplier is limited by the maximum multiplier.

8. The computer implemented method of claim 7, wherein the reduction factor is substantially equal to:

(Maximum Multiplier/(Quantity of Parameter Groups)*[(Total Actual Weight−Typical Actual Weight)/(Theoretical Maximum Weight)].

9. The computer implemented method of claim 8, further comprising:

adjusting the fan velocity for each fan included in the kitchen hood system from a pre-determined fan velocity reduction to an optimized fan velocity based on the reduction factor to optimize the energy savings associated with the kitchen hood system.

10. The computer implemented method of claim 9, wherein the adjustment in fan velocity is substantially equal to:

1−[(1−Pre-Determined Fan Velocity Reduction)* (Reduction Factor)].

11. The computer implemented method of claim 10, further comprising:

grouping the plurality of parameters into at least two groups of parameters, wherein the parameters included in each group have similar characteristics to each other.

12. The computer implemented method of claim 11, further comprising:

calculating a reduction factor for each group of parameters.

13. The computer implemented method of claim 12, further comprising:

calculating an overall reduction multiplier for the kitchen hood system that incorporates each reduction factor associated with each group of parameters; and adjusting the fan velocity for each fan included in the kitchen hood system based on the overall reduction multiplier to optimize the energy savings associated with the kitchen hood system.

14. The computer implemented method of claim 13, further comprising:

grouping the parameters included in the plurality parameters with physical characteristics into a physical parameter group, wherein the parameters with physical characteristics impact the overall efficiency of the kitchen hood system via physical characteristics associated the kitchen hood system; and grouping the parameters included in the parameters with make-up air design characteristics into a make-up air design parameter group, wherein the parameters with make-up air design characteristics impact the overall efficiency of the kitchen hood system via characteristics of a make-up air design associated with the kitchen hood system.

15. The computer implemented method of claim 14, further comprising:

calculating a hood parameter reduction factor for the parameters included the physical parameter group; and calculating a make-up air design parameter reduction factor for the parameters included in the make-up air design parameter group.

16. The computer implemented method of claim 15, wherein the overall reduction multiplier is substantially equal to:

1+(Hood Parameter Reduction Factor)+(Make-Up Air Design Parameter).

17. The computer implemented method of claim 16, further comprising:

adjusting the fan velocity for each fan included in the kitchen hood system from the pre-determined fan velocity reduction to the optimized fan velocity based on the overall reduction multiplier to optimize the energy savings associated with the kitchen hood system.

18. The computer implemented method of claim 17, wherein the adjustment in fan velocity is substantially equal to:

1−[(1−Pre-Determined Fan Velocity Reduction)* (Overall Reduction Multiplier)].

19. The computer implemented method of claim 18, further comprising:

decreasing the fan velocity for each fan included in the kitchen hood system from the pre-determined fan velocity reduction to the optimized fan velocity when the overall reduction multiplier is indicative of parameters included in the physical parameter group and parameters included in the make-up air design parameter group that are favorable to further reduction in the fan velocity from the pre-determined fan velocity reduction.

20. The computer implemented method of claim 19, further comprising:

increasing the fan velocity for each fan included in the kitchen hood system from the pre-determined fan velocity reduction to the optimized fan velocity when the overall reduction multiplier is indicative of parameters included in the physical parameter group and parameters included in the make-up air design parameter group that are not favorable to further reduction in the fan velocity from the pre-determined fan velocity reduction.

21. A kitchen hood system for optimizing energy savings, comprising:

an identification module configured to identify a plurality of parameters associated with the kitchen hood system, wherein each parameter is a fixed condition specific to the kitchen hood system and has an impact on an overall efficiency that the kitchen hood system operates;

a weighting module configured to weight each parameter, wherein a weight associated with each parameter is representative of a predicted impact each parameter has on the overall efficiency that the kitchen hood system operates relative to each other parameter;

an incorporation module configured to incorporate the weight of each parameter into a reduction factor, wherein the reduction factor is representative of an overall impact that the plurality of parameters has on the overall efficiency that the kitchen hood system operates; and an adjustment module configured to adjust a fan velocity for each fan included in the kitchen hood system based on the reduction factor to optimize the energy savings associated with the kitchen hood system.

22. The kitchen hood system of claim 21, wherein the weighting module is further configured to:

assign a factor to each parameter type associated with each parameter, wherein each parameter type is a different implementation associated with each respective parameter and the factor associated with each parameter type is representative of the predicted impact that each parameter type has on the overall efficiency that the kitchen hood system operates.

23. The kitchen hood system of claim 22, wherein the identification module is further configured to identify each parameter type that is associated with the kitchen hood system.

24. The kitchen hood system of claim 23, wherein the weighting module is further configured to multiply the factor associated with each identified parameter type with the weight associated with each respective parameter that each identified parameter type is associated with to obtain an actual weight for each respective parameter.

25. The kitchen hood system of claim 24, wherein the incorporation module is further configured to incorporate the actual weight for each respective parameter into the reduction multiplier.

26. The kitchen hood system of claim 25, wherein the adjustment module is further configured to adjust the fan velocity for each fan included in the kitchen hood system based on the reduction factor to optimize the energy savings associated with the kitchen hood system.

27. The kitchen hood system of claim 26, wherein the identification module is further configured to:

select a typical parameter type associated with each parameter, wherein the typical parameter type is the parameter type that is typically associated with the kitchen hood system.

28. The kitchen hood system of claim 27, wherein the weighting module is further configured to:

weight each selected typical parameter type associated with each parameter, wherein a typical weight associated with each typical parameter type is representative of the predicted impact each typical parameter type has on the overall efficiency that the kitchen hood system operates.

29. The kitchen hood system of claim 28, wherein the identification module is further configured to:

select a largest parameter type associated with each parameter, wherein the largest parameter type is the parameter type associated with a largest factor for each respective parameter.

30. The kitchen hood system of claim 29, wherein the weighting module is further configured to multiply the largest factor associated with the largest parameter type with the weight associated with each respective parameter that each largest parameter type is associated with to obtain a maximum weight for each respective parameter.

31. The kitchen hood system of claim 30, wherein the weighting module is further configured to:

add each actual weight for each respective parameter to obtain a total weight;

add each typical weight for each selected typical parameter type to obtain a total typical weight; and add each maximum weight for each respective parameter to obtain a total maximum weight.

32. The kitchen hood system of claim 31, wherein the identification module is further configured to:

determine a maximum multiplier, wherein the overall impact that the plurality of parameters has on the overall efficiency that the kitchen hood system operates as represented by the reduction multiplier is limited by the maximum multiplier.

33. The kitchen hood system of claim 32, wherein the reduction factor is substantially equal to:

(Maximum Multiplier/Quantity of Parameter Groups) *[(Total Actual Weight−Typical Actual Weight)/ Theoretical Maximum Weight)].

34. The kitchen hood system of claim 32, wherein the adjustment module is further configured to adjust the fan velocity for each fan included in the kitchen hood system from a pre-determined fan velocity reduction to an optimized fan velocity based on the reduction factor to optimize the energy savings associated with the kitchen hood system.

35. The kitchen hood system of claim 34, wherein the adjustment in fan velocity is substantially equal to:

1[(1−Pre-Determined Fan Velocity Reduction)*(Reduction Factor)].

36. The kitchen hood system of claim 35, wherein the identification module is further configured to:

group the plurality of parameters into at least two groups of parameters, wherein the parameters included in each group have similar characteristics to each other.

37. The kitchen hood system of claim 36, wherein the incorporation module is further configured to calculate a reduction factor for each group of parameters.

38. The kitchen hood system of claim 37, wherein the incorporation module is further configured to calculate an overall reduction multiplier for the kitchen hood system that incorporates each reduction factor associated with each group of parameters.

39. The kitchen hood system of claim 38, wherein the adjustment module is further configured to adjust the fan velocity for each fan included in the kitchen hood system based on the overall reduction multiplier to optimize the energy savings associated with the kitchen hood system.

40. The kitchen hood system of claim 39, wherein the identification module is further configured to:

group the parameters included in the plurality of parameters with hood characteristics into a physical parameter group, wherein the parameters with hood characteristics impact the overall efficiency of the kitchen hood system via characteristics of the kitchen hood system; and group the parameters included in the plurality of parameters with make-up air design characteristics into a make-up air design parameter group, wherein the parameters with make-up air design characteristics impact the overall efficiency of the kitchen hood system via characteristics of a make-up air design associated with the kitchen hood system.

41. The kitchen hood system of claim 40, wherein the incorporation factor is further configured to:

calculate a hood parameter reduction factor for the parameters included in the physical parameter group; and calculate a make-up air design parameter reduction factor for the parameters include in the make-up air design parameter group.

42. The kitchen hood system of claim 41, wherein the overall reduction multiplier is substantially equal to:

1+(Hood Parameter Reduction Factor)+(Make-Up Air Design Parameter).

43. The kitchen hood system of claim 42, wherein the adjustment module is further configured to adjust the fan velocity for each fan included in the kitchen hood system from the pre-determined fan velocity reduction to the optimized fan velocity based on the overall reduction multiplier to optimize the energy savings associated with the kitchen hood system.

44. The kitchen hood system of claim 43, wherein the adjustment in fan velocity is substantially equal to:

131 [(1−Pre-Determined Fan Velocity Reduction)* (Overall Reduction Multiplier)].

45. The kitchen hood system of claim 44, wherein the adjustment module is further configured to decrease the fan velocity for each fan included in the kitchen hood system from the pre-determined fan velocity reduction to the optimized fan velocity when the overall reduction multiplier is indicative of parameters included in the physical parameter group and parameters included in the make-up air design parameter group that are favorable to further reduction in the fan velocity from the pre-determined velocity reduction.

46. The kitchen hood system of claim 45, wherein the adjustment module is further configured to increase the fan velocity for each fan included in the kitchen hood system from the pre-determined fan velocity reduction to the optimized fan velocity when the overall reduction multiplier is indicative of parameters included in the physical parameter group and parameters included in the make-up air design parameter group that are not favorable to further reduction in the fan velocity from the pre-determined fan velocity reduction.

* * * * *